US006561756B2

(12) United States Patent
Ozawa et al.

(10) Patent No.: US 6,561,756 B2
(45) Date of Patent: May 13, 2003

(54) WATER PUMP

(75) Inventors: Yasuo Ozawa, Kariya (JP); Atsushi Chiba, Toyoake (JP); Masaki Chujo, Chiryu (JP); Junya Yamamoto, Toyota (JP)

(73) Assignee: Aisin Seiki Kabushiki Kaisha, Kariya (JP)

( * ) Notice: Subject to any disclaimer, the term of this patent is extended or adjusted under 35 U.S.C. 154(b) by 77 days.

(21) Appl. No.: 09/955,093

(22) Filed: Sep. 19, 2001

(65) Prior Publication Data

US 2002/0034438 A1 Mar. 21, 2002

(30) Foreign Application Priority Data

| | | |
|---|---|---|
| Sep. 19, 2000 | (JP) | 2000-284017 |
| Nov. 17, 2000 | (JP) | 2000-351665 |
| Mar. 9, 2001 | (JP) | 2001-067566 |

(51) Int. Cl.[7] ..... F04D 29/08

(52) U.S. Cl. ..... 415/111; 415/168.2; 415/174.2; 415/230; 416/60; 416/174; 417/362

(58) Field of Search ..... 415/110, 111, 415/168.1, 168.2, 170.1, 174.2, 174.3, 229, 230, 231; 416/174, 60

(56) References Cited

U.S. PATENT DOCUMENTS 4,983,101 A * 1/1991 Kunkel et al. ..... 417/362

FOREIGN PATENT DOCUMENTS

| | | |
|---|---|---|
| DE | 3716028 | 5/1987 |
| DE | 3828351 | 8/1988 |
| JP | 2-149822 | 5/1989 |
| JP | 4-262096 | 12/1990 |

* cited by examiner

*Primary Examiner*—Edward K. Look
*Assistant Examiner*—Dwayne J. White

(57) ABSTRACT

To provide a water pump capable of preventing coolant leaked from a shaft sealing member from invading a bearing by a simple construction, a water pump has an outer ring of a bearing attached to an inner peripheral face of a pulley, an inner ring of the bearing attached to an outer peripheral face of a cylindrical portion of a housing and a shaft sealing member attached to an inner peripheral face of the cylindrical portion.

22 Claims, 12 Drawing Sheets

WATER PUMP

BACKGROUND OF THE INVENTION

The present invention relates to a water pump for circulating a coolant of an internal combustion engine.

DESCRIPTION OF THE RELATED ART

In Japanese Patent Laid-Open No. 262096/1992, there is disclosed a water pump in which a support portion in a cylindrical shape surrounding a rotating shaft is provided at a pump case, an outer end of the rotating shaft projected outwardly from the support portion is integrally coupled with a pulley formed in a cylindrical shape surrounding the support portion, a bearing is interposed between an inner face of the pulley and an outer face of the support portion and only a seal member arranged concentrically with the bearing is interposed between an inner face of the support portion and the rotating shaft.

As shown by FIG. 12, the water pump disclosed in Japanese Patent Laid-Open No. 262096/1992, is provided with the support portion or a body 2A fixed to an attaching face of a cylinder block of an internal combustion engine, a pulley portion 40A rotated by a transmission member, a shaft portion 50A in a solid shape coaxially connected to a central region of the pulley portion 40A, a bearing 6A provided between the body 2A and the pulley portion 40A for making the pulley portion 40A rotatable relative to the body 2A and a rotating blade member 8A fitted and fixed to the shaft portion 50A. When a crankshaft of the internal combustion engine is driven, a belt 49A constituting the transmission member hung at the crankshaft and the pulley portion 40A is operated to circulate to thereby rotate the pulley portion 40A. When the pulley portion 40A is rotated, the shaft portion 50A connected to the pulley portion 40A is rotated in the same direction and the rotating blade member 8A is rotated in a pump chamber of the internal combustion engine. As a result, pumping operation is achieved.

Further, according to Japanese Patent Laid-Open No. 149822/1990, there is disclosed a water pump in which a pulley is arranged surrounding a bearing support portion of a pump housing, a drain hole is formed at a lower portion of a buffer chamber formed between a seal member arranging portion and a bearing arranging portion of the bearing support portion, the drain hole is opened to an inner face of the pulley and a water storing portion is formed at the inner face of the pulley.

Meanwhile, according to the conventional water pumps, when a coolant leaked from a shaft sealing member (mechanical seal) invades the bearing, this causes a drawback in which the bearing is corroded, the sliding resistance increases or the bearing is destroyed.

Therefore, according to the conventional water pumps, in order to prevent the coolant leaked from the shaft sealing member from invading the bearing, a plurality of seal members are interposed between an inner face of a support portion of the housing and the rotating shaft other than the shaft sealing member. However, although according to such a construction, the coolant can be prevented from invading the bearing, this poses a problem in that the number of parts attached to the housing increases, shapes or fabrication of the parts becomes complicated and cost of the parts increases since both the shaft sealing member and the other seal members are all needed.

Further, according to the water pump shown in FIG. 12, the shaft portion in the solid shape projected to the side of the pump chamber and the pulley portion are separate from each other; when the water pump is integrated, the pulley portion and the shaft portion in the solid shape are successively connected and, therefore, aspects of lightweight formation and integration performance are not necessarily satisfactory.

In addition thereto, in a water pump according to the conventional technology (for example, Japanese Patent Laid-Open No. 149822/1990), a liquid leaked from the water storing portion formed at the inner face of the pulley reaches a belt engaging face of the pulley by way of an outer peripheral face of the pulley. As is well known to one skilled in the art, the transmission of rotational force by the pulley is carried out by rotating the shaft via friction force operated between the belt and the pulley by the belt constituting rotational force transmitting means. Therefore, when the liquid adheres to the belt engaging face of the pulley, there is concern for reducing the friction force and causing a loss in transmitting the rotational force. Further, the belt is generally constructed by rubber and, therefore, this poses a problem in that the belt is swollen by the adhering of the liquid, and thus its strength decreases.

SUMMARY OF THE INVENTION

Therefore, it is a technical problem of the invention to provide a water pump capable of preventing coolant leaked from a shaft sealing member from invading a bearing by a small-sized, light-weight and simple construction.

Further, it is a technical problem of the invention to be resolved, in addition to the above-described problem, to provide a water pump capable of ensuring drawability of a shaft portion integrally formed with a pulley portion of a pulley member and advantageous in shortening a length of the shaft portion.

Further, it is a technical problem of the invention to provide a water pump capable of preventing a liquid leaked from a shaft sealing member from reaching a belt engaging face by a small-sized, light-weight and simple construction.

According to an aspect of the invention, the above-described problems are resolved by providing a water pump comprising:

- a pulley rotated by receiving a torque from a drive source, and having a shaft portion which is integrally formed therewith and extended in a shaft core direction at a central portion thereof;
- an impeller fixed to the shaft portion and rotated integrally with the shaft portion;
- a body forming a water chamber arranged with the impeller;
- a cylindrical portion provided by projecting from the body in a cylindrical shape;
- a bearing rotatably supporting the pulley at the cylindrical portion; and
- a shaft sealing member for sealing the bearing against the water chamber;
- wherein the shaft sealing member is attached to either one of an inner peripheral face and an outer peripheral face of the cylindrical portion.

Preferably, the shaft portion includes a hollow chamber, the impeller includes a central boss portion and blades, and the central boss portion is fitted to an inner portion of the shaft hollow chamber of the shaft portion.

An outer ring of the bearing is attached to an inner peripheral face of the pulley, an inner ring thereof is attached to an outer peripheral face of the cylindrical portion and the shaft sealing member is attached to an inner peripheral face of the cylindrical portion and the pulley is provided with a projected portion projected to an outer side in a diameter direction in a space between the shaft sealing member of the pulley and the bearing.

According to a preferred example of the invention, the inner ring of the bearing is attached to the outer peripheral face of the cylindrical portion formed at the body and the shaft sealing member is attached to the inner peripheral face of the cylindrical portion and, therefore, at least portions of the shaft sealing member and the bearing in the axial direction, which have conventionally been arranged at positions extended in the axial direction, can be arranged to overlap, and the length of the shaft portion of the water pump in the axial direction can be shortened. Therefore, the water pump can be downsized and its mountability can be promoted.

The pulley member used in the invention is provided with a pulley portion rotated by a wrapping transmission member such as a belt and the shaft portion integral with the pulley portion. The shaft portion is provided at a central region of the pulley portion by squeeze-drawing substantially coaxially therewith. The shaft portion is constructed by a cylindrical shape penetrated in the axial length direction and is provided with the shaft hollow chamber extended in the axial length direction, a front end opening disposed on a front end side of the shaft hollow chamber, and a base end opening disposed on a base end side of the shaft hollow chamber. In this way, the shaft portion is constructed by the cylindrical shape extending in the axial length direction and is constructed by an unbottomed hollow shape which is not provided with a bottom wall portion. Therefore, in comparison with a case of a bottomed hollow portion having the bottom wall portion, the squeeze-drawability of a peripheral wall of the shaft portion is ensured.

Further, a central boss portion of a rotating blade member is fitted to an inner portion of the shaft hollow chamber of the shaft portion of the pulley member. Therefore, in comparison with the case in which the central boss portion of the rotating blade member is fitted to an outer portion of the shaft portion of the pulley member, a projecting degree of projecting a front end portion in the axial length direction of the shaft portion to a side of the rotating blade member is reduced. The above-described construction is thus advantageous in shortening the formation of the axial length of the shaft portion and also in this regard, the squeeze-drawability of the shaft portion is ensured.

Further, according to a preferable example of the invention, a liquid leaked from the shaft sealing member is dropped at a portion provided at the pulley and projected to an outer side in the diameter direction. A water cutting effect is thus achieved and the liquid can be prevented from adhering to the belt by the flowing of the liquid to the belt engaging face of the pulley engaged with the belt.

The projected portion of the pulley can store a predetermined amount or volume of the liquid. At this occasion, the level of the stored liquid can always be made lower than the inner peripheral face of the belt engaging face by adjusting means. Therefore, the stored liquid can be prevented from invading the inner peripheral face of the belt engaging face.

DETAILED DESCRIPTION OF THE PREFERRED EMBODIMENTS

Figure 1:
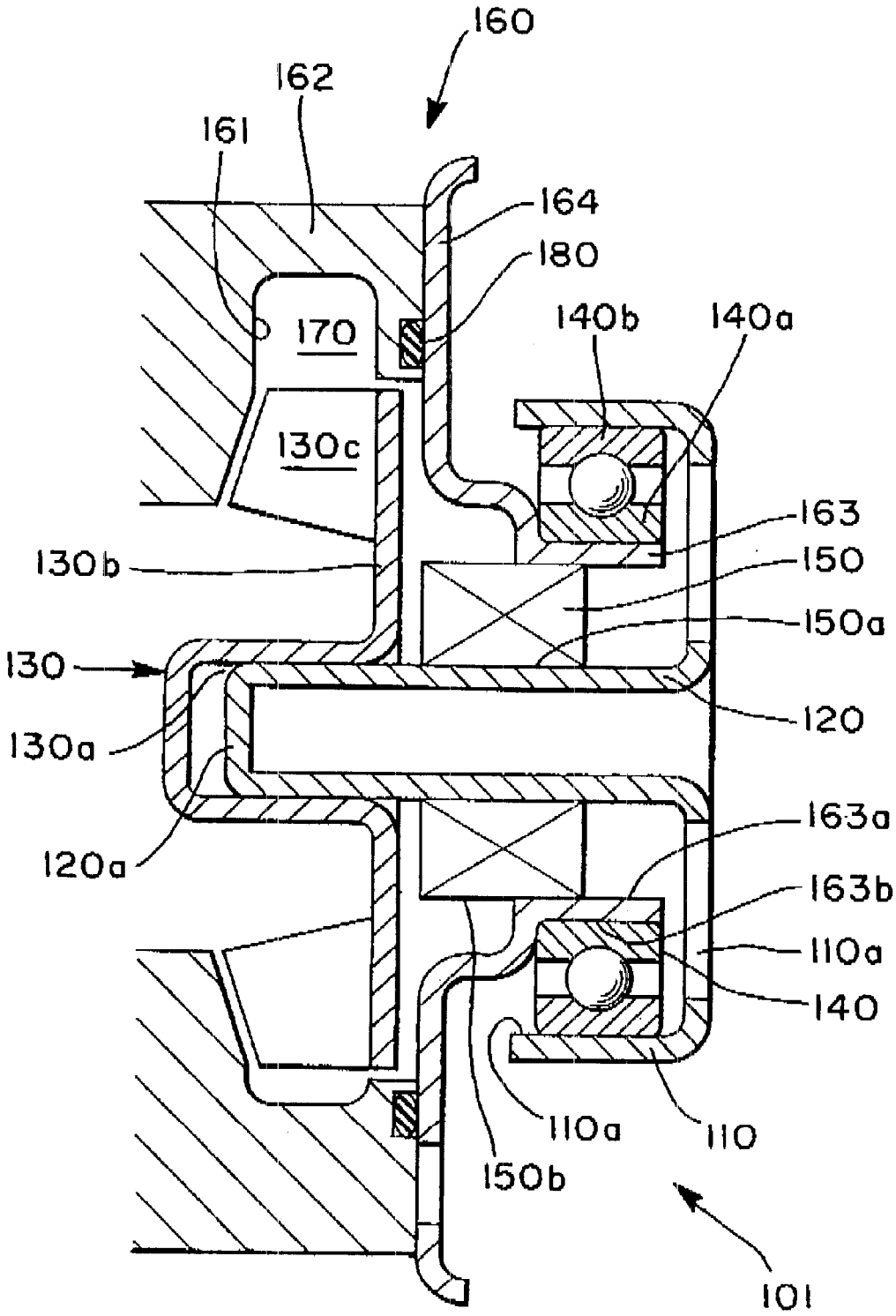
FIG. 1 is a sectional view of a water pump showing a first embodiment of the invention.

FIG. 1 is a sectional view of a water pump showing a first embodiment of the invention.

In FIG. 1, a water pump 101 is constructed by a pulley 110, an impeller 130, a bearing 140, a shaft sealing member 150, a housing (body) 160 and a seal member 180.

The pulley 110 is formed in the shape of a cylindrical cup and at center of the bottom face, there is formed a shaft portion 120 projected in a cylindrical shape in a direction remote from the bottom face. Outer peripheral faces of the shaft portion 120 and the pulley 110 are concentrically arranged. The pulley 110 is formed by pressing a plate-like member such as a steel plate that has been subjected to a corrosion resistant processing. Thus, the pulley 110 having a pulley member and the shaft portion 120 is formed from one sheet of a metal plate member by a pressing and/or squeezing process. The shaft portion 120 is formed in a shape of a hollow cylinder as illustrated.

The impeller 130 is an "open-type" impeller having a base portion **130*b* and several sheets of blades 130*c* projecting therefrom. There is formed a recess portion 130*a* for attaching the shaft portion 120 at a center of the base portion 130*b* of the impeller 130. The recess portion 130*a* and the shaft portion 120** are attached unrotatably relative to each other by press-fitting in this embodiment.

The housing 160 is constructed by a main body portion 162 having a suction port, a delivery port (not illustrated) and recess portion 161 and a body bottom portion 164 attached to an end face of the main body portion 162. The main body portion 162 may be formed from an aluminum die-cast product or may be constructed integrally with a cylinder block or a timing belt case of an engine.

The body bottom portion 164 is formed substantially in a shape of a circular disk and a cylindrical portion 163 having a diameter smaller than an outer diameter of the main body portion 162, is formed to project in a direction remote from the main body portion 162 at a vicinity of its center. The body bottom portion 164 is formed by pressing a plate-like member, such as a steel plate that has been subjected to a corrosion preventive processing. The main body portion 162 and the body bottom portion 164 are coupled by bolts (not illustrated) via the seal member 180. Therefore, a space is formed to maintain water-tightness between the recess portion of the main body portion 162 and the body bottom portion 164.

The space constitutes a water chamber 170 and the impeller 130 is arranged in the water chamber 170.

An inner peripheral face 163*a* of the cylindrical portion 163 of the body bottom portion 164, is attached with an outer peripheral face 150*b* of the shaft sealing member 150 unrotatably relative to each other by press-fitting. Furthermore, an outer peripheral face of the shaft portion 120 is attached with an inner peripheral face 150*a* of the shaft sealing member 150 similarly by press-fitting. Here, the inner and the outer peripheral faces 150*a* and 150*b* are made rotatable relative to each other, although not illustrated. The shaft portion 120 is rotatably supported relative to the housing 160 by the shaft sealing member 150. Here, the shaft sealing member 150 is a publicly-known mechanical seal.

Further, an outer peripheral face 163*b* of the cylindrical portion 163 of the body bottom portion 164 is attached with an inner ring 140*a* unrotatably relative to each other by press-fitting. Meanwhile, an inner peripheral face of the pulley 110 is attached with an outer ring 140*b* of the bearing 140 unrotatably relative to each other by press-fitting. Here, the bearing 140 is a commonly known roller bearing.

Therefore, the pulley 110 is supported by the housing 160 rotatably relative to each other by the bearing 140.

With regard to positions of the shaft sealing member 150 and the bearing 140, in the axial direction, at least portions of respective members are arranged to overlap.

Next, an explanation will be given of the operation of the first embodiment.

The pulley 10 is rotated by rotational force transmitted from an output shaft of an engine (not illustrated) via the belt (not illustrated) expanded to an outer peripheral face of the pulley 110. With rotation of the pulley 110, the shaft portion 120 integrally formed with the pulley 110 is also rotated in the same direction. Further, the impeller 130 integrated with the shaft portion 120 is rotated in the water chamber 170 in the housing 160.

Now, the coolant is filled in the water chamber 170 and, therefore, by centrifugal force produced by rotating the impeller 130, the coolant disposed at a vicinity of a center of the water chamber 170 is delivered by the impeller 130 in an outer peripheral direction of the impeller 130. In this way, there is produced pumping operation by the centrifugal force from the center of the impeller 130 to its outer side. Therefore, there is produced a pressure difference between the vicinity of the rotational center of the impeller 130 and its outer peripheral side in the water chamber 170 and the coolant is sucked from an intake port (not illustrated) provided at the vicinity of the rotational center of the impeller 130 into the water pump 101.

Further, the coolant is pressurized to the outer peripheral side by the pumping operation of the impeller 130 and supplied from a delivery port (not illustrated) provided on the outer peripheral side to respective portions of the engine to be cooled.

Whereas the coolant is filled in the water chamber 170, the pulley 110 is opened through a plurality of openings 110*a* to the atmosphere. However, an interval between the main body portion 162 and the body bottom portion 164 is hermetically closed by the seal member 180 and the shaft portion 120 is hermetically closed by arranging the shaft sealing member 150.

As described above, according to the first embodiment, the bearing 140 and the shaft sealing member 150 are attached to the same member, that is, the outer peripheral face 163*b* and the inner peripheral face 163*a* of the cylindrical portion 163 of the body bottom portion 164. Thus, the bearing 140 and the shaft sealing member 150 which has been arranged to align in the axial direction conventionally, can be arranged at the same position in the axial direction at least partially, that is, both members can be arranged to overlap in the axial direction. Therefore, the length of the water pump 101 in the axial direction can be shortened and mountability of the water pump 1 to the engine can be promoted.

(Second Embodiment)

Figure 2:
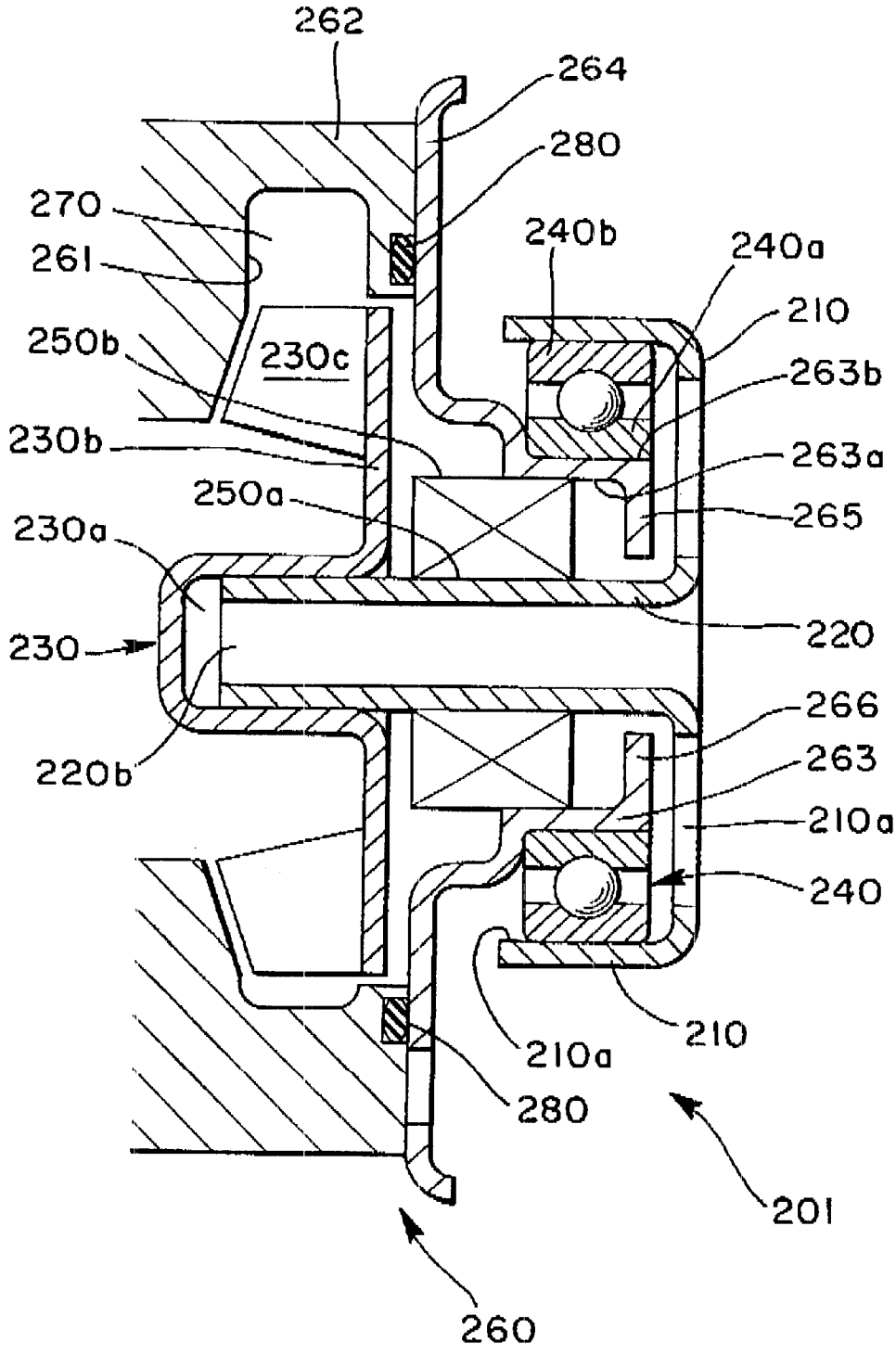
FIG. 2 is a sectional view of a water pump showing a second embodiment of the invention.

FIG. 2 is a sectional view of a water pump 201 showing a second embodiment of the invention. FIG. 2 differs from FIG. 1 only in portions of shapes of a shaft portion 220 and a body bottom portion 264, the other construction is the same as that of the first embodiment and, therefore, there are used numerical notations produced by adding 200 to numeral notations of FIG. 1 and an explanation will be omitted with regard to a construction duplicated with that of the first embodiment.

In FIG. 2, there is provided a through hole 220*b* at an end face 220*a* of the shaft portion 220. The through hole 220*b* is used in attaching an impeller 230 to the shaft portion 220 unrotatably relative to each other by press-fitting for positioning the impeller 230 in the axial direction. When a clearance between a blade 230*c* of the impeller 230 and a housing 260 is large, a pumping function of the impeller 230 is deteriorated and when the clearance is small, there is a possibility of making the impeller 230 collide with the housing 260. Therefore, a high degree of accuracy is needed in a position of attaching the impeller 230 and the shaft portion 220 in the axial direction.

However, by providing the through hole 220*b* at the end face 220*a* of the shaft portion 220, the impeller 230 and the shaft portion 220 can be attached while measuring positions thereof by inserting a jig and, accordingly, the impeller 230 can be attached thereto accurately in its position in the axial direction.

Meanwhile, a distance between a pulley 210 and the impeller 230 in the axial direction is determined by the length of the shaft portion 220 connecting both members. Therefore, the length of the shaft portion 220 to some degree is significant. However, when a slender hollow shape is formed from a plate-like member by pressing, a wrinkle or crack may be caused at a portion constituting a bottom of the slender hollow shape (corresponding to the end face 220*a* of the shaft portion 220). Therefore, by providing the through hole 220*b* at the end face 220*a* of the shaft portion 220, wrinkles or cracks can be prevented, and the formability of pulley 210 can be promoted.

Further, at a side end face of a cylindrical portion 263 of the body bottom portion 264 on the side of the pulley 210, there is provided a flange portion 265 integrally formed by being folded to bend in a direction of contracting its diameter to be smaller than a diameter of an outer peripheral face 250*b* of a shaft sealing member 250 over an entire periphery of the cylindrical portion. There is formed a space 266 in the shape of a groove by the flange portion 265, the shaft sealing member 250 and an inner peripheral face 263*a* of the cylindrical portion 263. The space 266 in the groove-like shape operates as follows. A very small amount of the coolant may leak at the shaft sealing portion 250 as its characteristic.

However, the coolant leaked from the shaft sealing member 250 is temporarily stored at the groove-like space 266 formed by the shaft sealing member 250, the inner peripheral face 263*a* of the cylindrical portion 263 and the flange portion 265. The amount of the coolant leaked from the shaft sealing member 250 is very small and, therefore, the coolant hardly overflows from the groove-like space 266 and reaches the vicinity of a bearing 240.

Further, the leaked coolant stored at the groove-like space 266 evaporates by friction heat generated by rotating the bearing 240, discharged outside from holes 210*a* formed at the pulley 210, and the leaked coolant does not reach the vicinity of the bearing 240.

As described above, according to the second embodiment, by providing the through hole 220*b* at the end face 220*a* of the shaft portion 220, accuracy is promoted in the attaching position in the axial direction when the impeller 230 is attached to the shaft portion 220 and the formability of the shaft portion 220 and the pulley 210 can be promoted.

Furthermore, by providing the flange portion 265 formed by folding to bend the end face of the cylindrical portion 263 on the side of the pulley 210 in the direction of contracting the diameter more than the diameter of the outer peripheral face 250*b* of the shaft sealing member 250 over the entire periphery of the cylindrical portion 263, there can be provided the groove-like space 266, capable of temporarily storing the coolant leaked from the shaft sealing member 250 and the leaked coolant can be prevented from invading the vicinity of the bearing 240.

(Third Embodiment)

Figure 3:
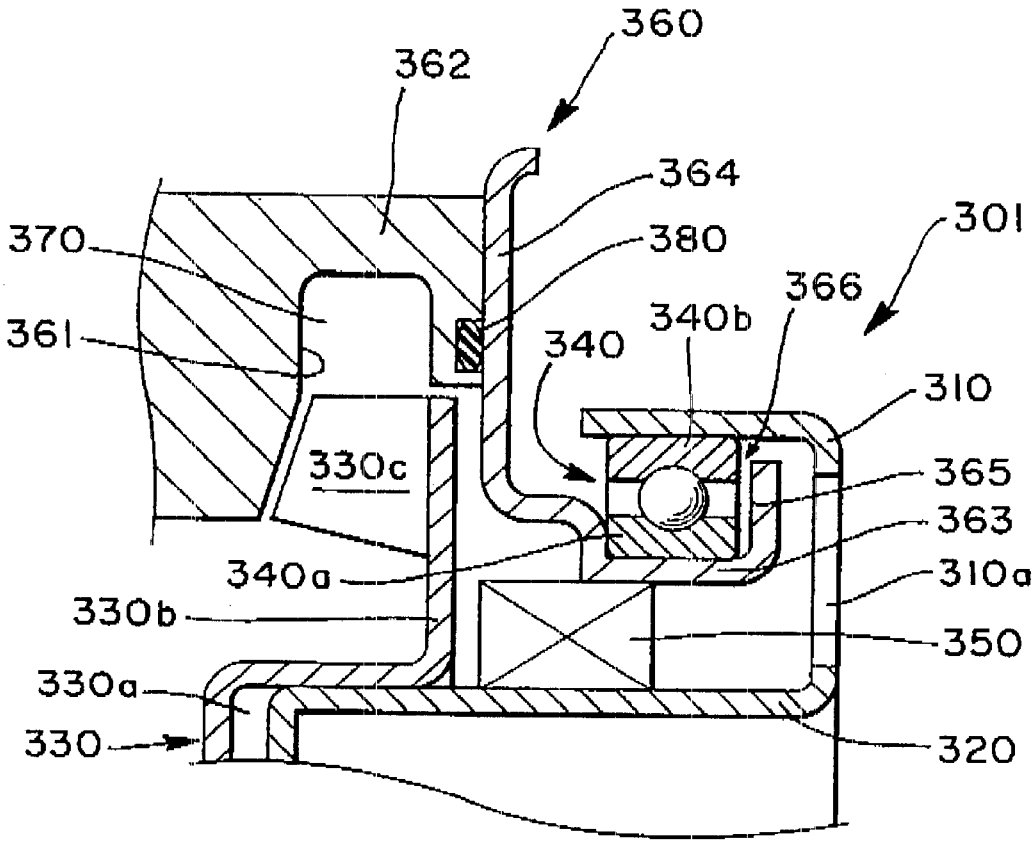
FIG. 3 is a sectional view of essential portions of a water pump showing a third embodiment of the invention.

FIG. 3 is a sectional view of essential portions of a water pump 301 showing a third embodiment of the invention. FIG. 3 differs from FIG. 1 partially in a shape of a body bottom portion 364 and the other construction is the same as that of the first embodiment and, therefore, there are used numeral notations produced by attaching 300 to numeral notations of FIG. 1 and an explanation is unnecessary with regard to a construction duplicated with that of the first embodiment.

In FIG. 3, at an end face of a cylindrical portion 363 of the body bottom portion 364 on the side of a pulley 310, there is provided a flange portion 365 integrally formed by being folded to bend to a direction of enlarging its diameter more than the diameter of an inner ring 340*a* of a bearing 340. A clearance formed between the flange portion 365 and the bearing 340 in the axial direction is very small. Therefore, there can be formed a labyrinth shape 366 having a very small clearance between an end face of the bearing 340 on the side of the pulley 310 and an end face of the flange portion 365 on a side of a housing 360. By the labyrinth shape 366, the coolant leaked from a shaft sealing member 350 has difficulty invading an end face of the bearing 340.

As described above, according to the third embodiment, by the flange portion 365 integrally formed by being folded to bend in the direction of enlarging the diameter of the end face of the cylindrical portion 363 of the body bottom portion 364 on the side of the pulley 310 more than the inner ring 340*a* of the bearing 340, the labyrinth shape 366 can be formed at the end face of the bearing 340 on the side of the pulley 310. Thus, the coolant produced and leaked from the shaft sealing member 350 can be prevented from invading from the end face of the bearing 340 to inside of the bearing 240.

(Fourth Embodiment)

Figure 4:
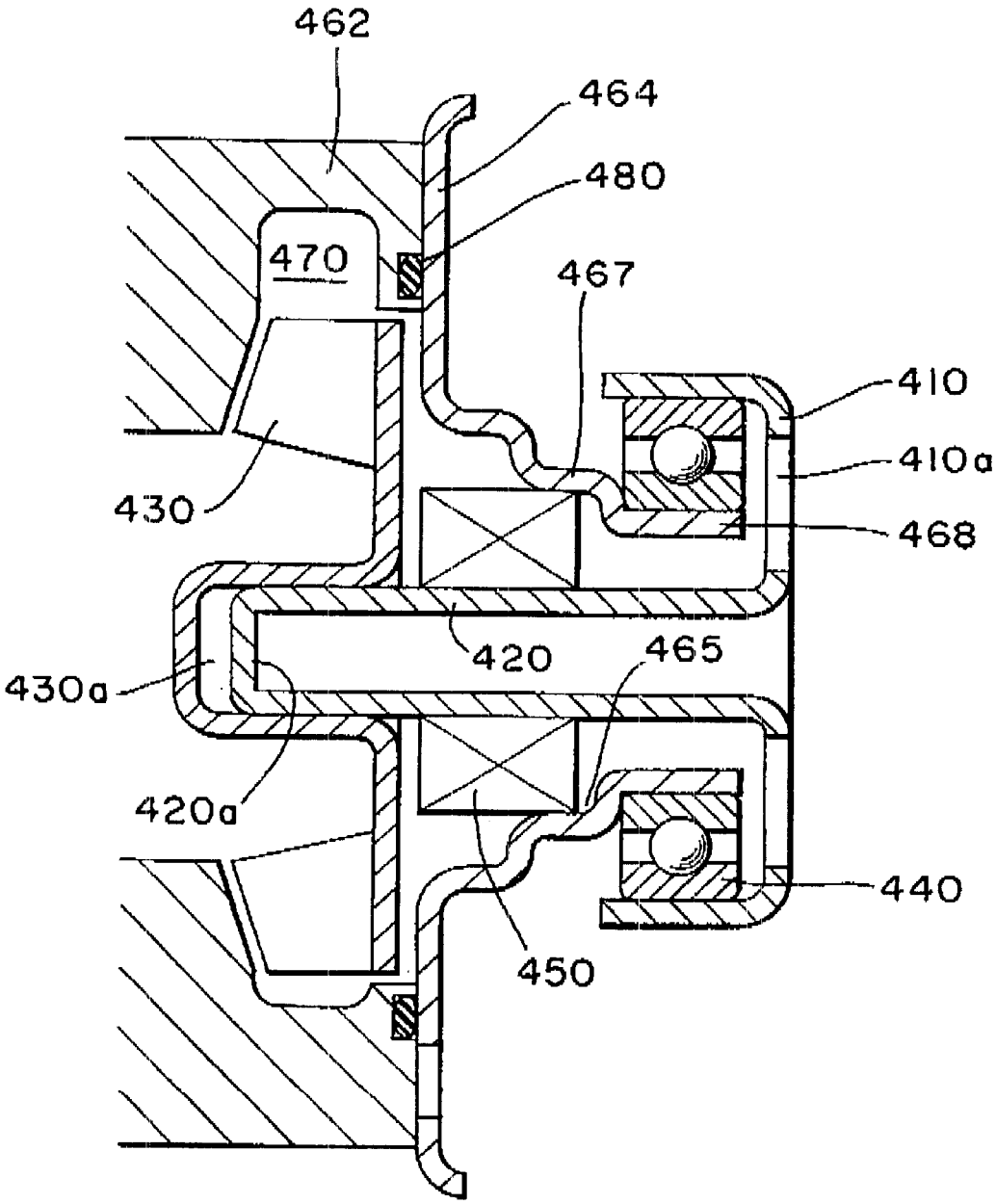
FIG. 4 is a sectional view of essential portions of a water pump showing a fourth embodiment of the invention.

FIG. 4 is a sectional view of a water pump showing a fourth embodiment of the invention.

FIG. 4 differs from FIG. 1 partially in a shape of a body bottom portion 464, the other elements are otherwise the same as those of the first embodiment and, therefore, numerical notations are used which are produced by adding 400 to the numeral notations of FIG. 1 and an explanation is unnecessary with regard to a construction duplicating with that of the first embodiment.

The body bottom portion 464 is provided with a cylindrical portion 467 having a small diameter attached with an inner ring of a bearing 440. Further, there is provided a cylindrical portion 468 having a large diameter attached with an outer peripheral face of a shaft sealing member 450 further to the side of a main body 462. The cylindrical portions 467 and 468 are constructed by a member the same as that of the body bottom portion 464. The cylindrical portion 467 having the small diameter and the cylindrical portion 468 having the large diameter are formed in a step-like shape.

Therefore, a shaft sealing member 450 and the bearing 440 can be arranged to overlap in their diameter directions and, therefore, the size of a pulley 410 in the diameter direction can be reduced. Thus, the mountability of the water pump to the engine can be promoted.

Further, the inner diameter of the bearing may be smaller than the outer diameter of the shaft sealing member and, therefore, the bearing can be downsized and the mass and cost thereof can be reduced.

(Fifth Embodiment)

A specific explanation will be given of a fifth embodiment of the invention in reference to FIG. 5 as follows.

A cylinder block 510 constituting an internal combustion engine 501 which is a base portion attached to a water pump, is formed with a pump chamber 511 communicating with a cooling water path to open at an attaching face 513.

Figure 5:
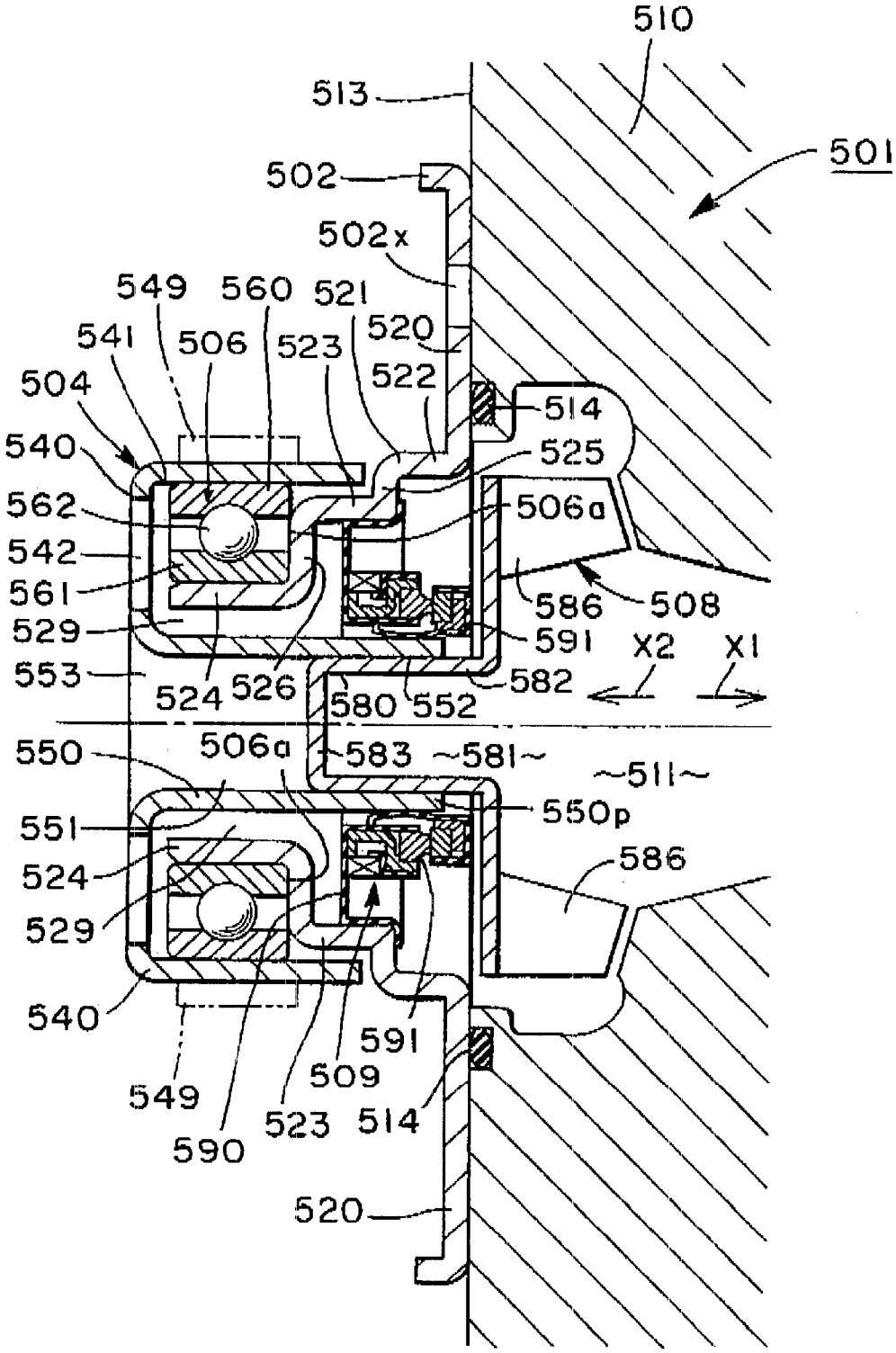
FIG. 5 is a sectional view of a water pump according to a fifth embodiment.

In FIG. 5, an arrow mark X1 direction indicates a direction directed from outside to an inner portion of the cylinder block 510 of the internal combustion engine 501 in the axial length direction of a shaft portion 550. An arrow mark X2 direction indicates a direction from the inner portion of the cylinder block 510 of the internal combustion engine 501 to the outer portion in the axial length direction of the shaft portion 550.

The water pump is fixed to the attaching face 513 of the cylinder block 510 and is provided with a body 502, a pulley member 504, a bearing 506 and a rotating blade member 508. The body 502 is fixed to the attaching face 513 of the cylinder block 510 constituting the internal combustion engine 501 by bolts, not illustrated, penetrating attaching holes 502*x*. The body 502 is formed by pressing or form-rolling one sheet of a plate member made of metal (generally, steel species).

The body 502 is provided with an attaching flange portion 520 provided to the attaching face 513 of the cylinder block 510 via a seal portion 514 in a ring-like shape and a cylindrical portion 521 formed at a central region of the attaching flange portion 520.

The cylindrical portion 521 is formed from a shape of a stepped hollow cylinder and is provided with a first cylindrical portion 522 along the axial length direction, a second cylindrical portion 523 along the axial length direction having a diameter set to be smaller than a diameter of the first cylindrical portion 522, a third cylindrical portion 524 along the axial length direction having a diameter set to be smaller than the diameter of the second cylindrical portion 523, a first erected wall portion 525 along a direction orthogonal to the axial direction connecting the first cylindrical portion 522 and the second cylindrical portion 523 and a second erected wall portion 526 along the direction orthogonal to the axial direction connecting the second cylindrical portion 523 and the third cylindrical portion 524.

The pulley member 504 is made of metal and is provided with a pulley portion 540 rotated by a belt 549 as a wrapping transmission member circulated by a crankshaft of the internal combustion engine 501 and is provided with a shaft portion 550 forming a shape of a hollow cylinder penetrating in the axial length direction. The pulley member 504 comprising the pulley portion 540 and the shaft portion 550 is formed from one sheet of a plate member made of metal. The pulley portion 540 is provided with an outer ring portion 541 along the axial length direction and an erected wall portion 542 along the direction orthogonal to the axial direction and is formed by pressing.

The shaft portion 550 is formed in the shape of a hollow cylinder by squeeze-drawing and is formed substantially coaxially with the pulley portion 540 to be continuous from an inner peripheral side of the erected wall portion 542 of the pulley portion 540. The shaft portion 550 is provided with a shaft hollow chamber 551 partitioned by a peripheral wall and extended in the axial length direction, a front end opening 552 disposed on a front end side (side of the cylinder block 510 of the internal combustion engine 501) of the shaft hollow chamber 551 and a base end opening 553 disposed on a base end side (side reverse to the cylinder block 510 of the internal combustion engine 501) of the shaft hollow chamber 551.

The shaft portion 550 is light-weight by forming a cross-sectional face of a hollow cylindrical shape in a circular shape. Therefore, the diameter of the shaft portion 550 is substantially made constant along the axial length direction; however, the diameter is not limited thereto. According to the embodiment, as shown by FIG. 5, although a front end 550*p* of the shaft portion 550 is extended in the arrow mark X1 direction along the axial length direction, the front end 550*p* does not reach the pump chamber 511 of the cylinder block 510 of the internal combustion engine 501 and does not reach the attaching face 513 of the cylinder block 510. However, the invention is not limited thereto.

The bearing 506 makes the pulley member 504 rotatable relative to the body 502 and is provided in a ring-like shape outer ring 560, an inner ring 561 in a ring-like shape and a plurality of rolling bodies 562 interposed therebetween. The bearing 506 is held between the body 502 and the pulley member 504. Specifically, the bearing 506 is provided between an outer peripheral face of the third cylindrical portion 524 having a small diameter in the cylindrical portion 521 of the body 502 and an inner peripheral face of the outer ring portion 541 of the pulley portion 540.

Therefore, an inner peripheral face of the bearing 506 is held by the third cylindrical portion 524 of the body 502 and an outer peripheral face of the bearing 506 is held by the outer ring portion 541 of the pulley portion 540. In this way, the bearing 506 is held by utilizing the third cylindrical portion 524 having the smallest diameter in the cylindrical portion 521 of the body 502 and, therefore, downsizing of the diameter of the bearing 506 can be dealt with.

According to the embodiment, the third cylindrical portion 524 of the body 502 and the inner peripheral face of the bearing 506 are fixedly press-fitted. The outer ring portion 541 of the pulley portion 540 of the pulley member 504 and the outer peripheral face of the bearing 506 are fixedly press-fitted. By fixedly press-fitting these members, holding performance with regard to the bearing 506 is ensured and detachment preventive performance of the bearing 506 is promoted. Further, the second erected wall portion 526 of the cylindrical portion 521 of the body 502 is provided to an axial end 506*a* (side opposed to the cylinder block 510 of the internal combustion engine 501) of the bearing 506 as a stopper, the holding performance with regard to the bearing 506 is further ensured and the detachment preventive performance of the bearing 506 is further promoted.

The rotating blade member 508 formed by pressing, is made of metal and is provided with a central boss portion 580 subjected to squeeze-drawing and a plurality of blades 586 integrally held by the central boss portion 580. The central boss portion 580 is disposed on the reverse side of the blades 586 in the axial length direction of the shaft portion 550.

The central boss portion 580 of the rotating blade member 508 is constructed by a bottomed hollow shape and is provided with a pipe body 582 having a hollow chamber 581 and a closed wall 583 for closing a front end side of the hollow chamber 581 of the pipe body 582. The central boss portion 580 provided on the reverse side of the blades 586 of the rotating blade member 508, is fixedly press-fitted to an inner portion of the shaft hollow chamber 551 of the shaft portion 550 of the pulley member 504. In other words, an outer wall face of the pipe body 582 of the central boss portion 580 of the rotating blade member 508 is press-fitted to an inner wall face of the pulley member 504 partitioning the shaft hollow portion 551 of the shaft portion 550.

As shown by FIG. 5, the closed wall 583 of the central boss portion 580 of the rotating blade member 508 advances into the shaft hollow chamber 551 in a penetrated state of the shaft portion 550 of the pulley member 504, closes inside of the shaft hollow chamber 551, brings inside of the shaft hollow chamber 551 into a non-communicated state and prevents water in the pump chamber 551 of the cylinder block 510 from leaking to the shaft hollow chamber 551 of the shaft portion 550.

Furthermore, the hollow chamber 581 of the pipe body 582 of the rotating blade member 508 is directly opposed to the pump chamber 511 of the cylinder block 510. In this case, the above construction is advantageous in increasing the volume of the pump chamber 511.

Sealing means 509 is provided by utilizing press-fitting between the shaft portion 550 of the pulley member 504 and the body 502. The sealing means 509 is formed by a seal plate 590 in a ring-like shape provided between the second cylindrical portion 523 of the body 502 and the shaft portion 550 for sealing the pump chamber 511 and a commonly known mechanical seal 591. By the sealing means 509, water in the pump chamber 511 of the cylinder block 510 is prevented from leaking to the side of the bearing 506.

As shown by FIG. 5, a double wall structure is constructed by the peripheral wall of the shaft portion 550 and the peripheral wall of the pipe body 582 of the rotating blade member 508 and, therefore, the construction is advantageous in strengthening the shaft portion 550 provided with the sealing means 509. In addition, there is formed a clearance 529 in a ring-like shape between the third cylindrical portion 524 of the cylindrical portion 521 of the body 502 and the shaft portion 550. Further, the clearance 529 is covered by the pulley portion 540 and, therefore, the clearance 529 cannot be visually recognized from outside.

In using the embodiment, the belt 549 is positioned in an endless shape constituting the wrapping transmission member over the crankshaft of the internal combustion engine 501 and the outer ring portion 541 of the pulley portion 540 of the pulley member 504.

When the crankshaft is driven by driving the internal combustion engine 501 and the belt 549 is circulated, the pulley member 504 comprising the pulley portion 540 and the shaft portion 550 is rotated integrally therewith. Therefore, the blades 586 of the rotating blade member 508 connected to the shaft portion 550 are rotated in the same direction inside the pump chamber 511 of the internal combustion engine 501, water in the pump chamber 511 is delivered in the centrifugal direction, pumping operation by the blades 586 is achieved and water for cooling is circulated inside water paths (not illustrated) of the cylinder block 510.

As explained above, according to the embodiment, the pulley member 504 is provided with the pulley portion 540 rotated by the belt 549 and the shaft portion 550 integral with the pulley portion 540, the shaft portion 550 is constructed by the shape of the hollow cylinder penetrated in the axial length direction and is provided with the shaft hollow chamber 551, the front end opening 552 disposed on the front end side of the shaft hollow chamber 551 and the base end opening 553 disposed on the base end side of the shaft hollow chamber 551.

In this way, the shaft portion 550 is constructed by the shape of the hollow cylinder penetrating in the axial length direction and is formed by a unbottomed hollow shape which is not provided with a bottom wall portion and, therefore, in comparison with the case of the bottomed hollow shape having the bottom wall portion, drawability of the shaft portion 550 of the pulley member 504 is promoted.

Figure 12:
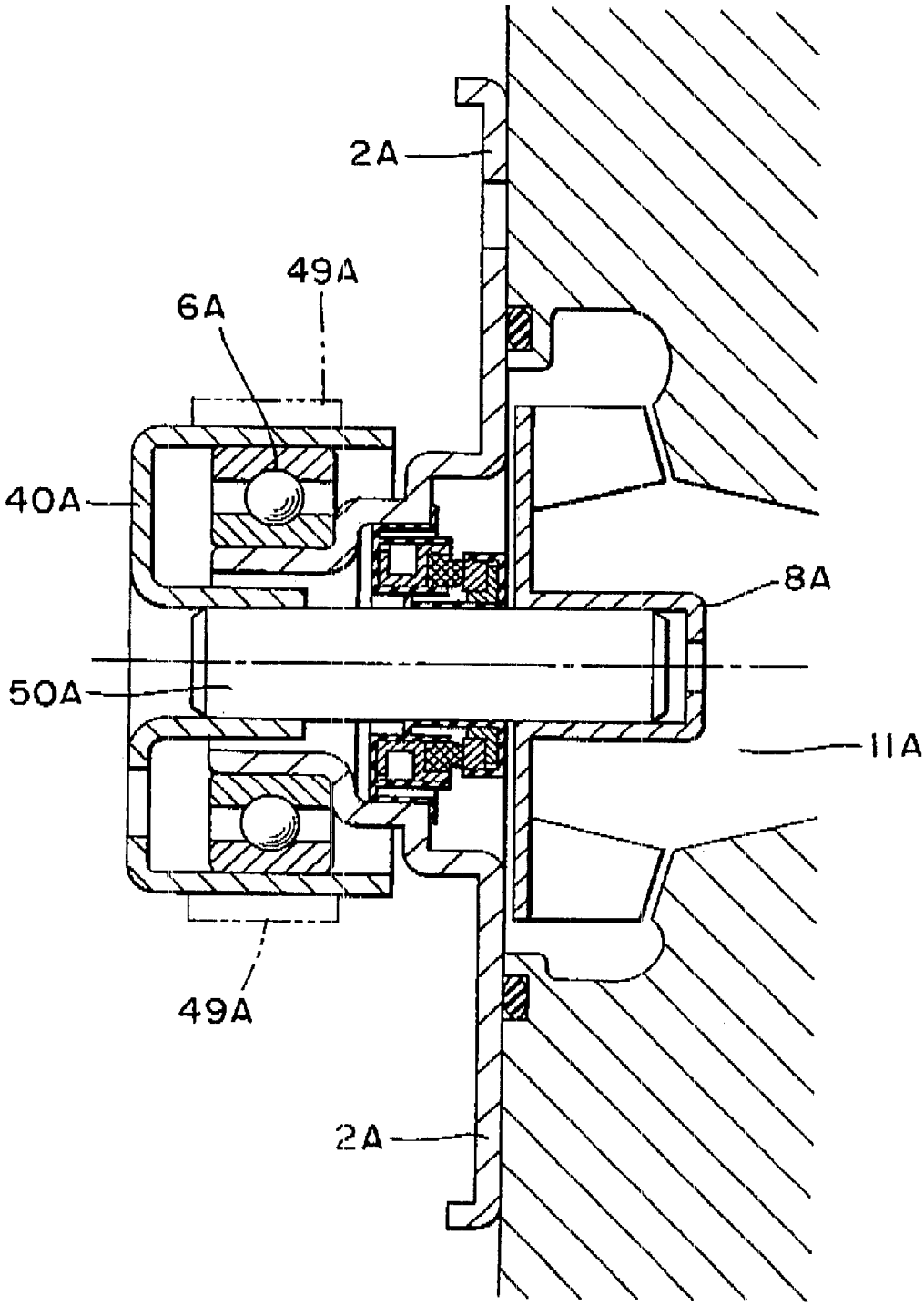
FIG. 12 PRIOR ART
FIG. 12 is a sectional view of a water pump according to a conventional technology.

Further, according to the embodiment, the central boss portion 580 of the rotating blade member 508 is fitted inside the shaft hollow chamber 551 of the shaft portion 550 of the pulley member 504. Therefore, unlike when the central boss portion of the rotating blade member is fitted to an outer portion of the shaft portion of the pulley member as shown by FIG. 12, a projecting degree for projecting the front end 550*p* in the axial length direction of the shaft portion 550 to the side of the rotating blade member 508 is reduced.

Thus, the front end 550*p* in the axial length direction of the shaft portion 550 according to the embodiment may not be projected excessively to the side of the pump chamber 551 such that the front end 550*p* is further extended into the pump chamber 511 of the cylinder block 510.

In this way, according to the embodiment, the degree of extension of the front end portion in the axial length direction of the shaft portion 550 of the pulley member 504 to the rotating blade member 508, which is to the side of the pump chamber 511, is reduced, and shortened formation of the axial length of the shaft portion 550 can be achieved. Also in this regard, the drawability of the shaft portion 550 is ensured.

Therefore, according to the embodiment, even in the case of a severe drawing condition, uniform formation of a wall thickness in the peripheral wall of the shaft portion 550 is promoted. As a result, even in the case of rotating the pulley member 504, particularly in the case of rotating the pulley member 504 at a high speed, the construction is further advantageous in balancing the formation of rotational balance in the shaft portion 550 of the pulley member 504.

When shaft portion 550 is further rotationally balanced as described above, the deflection of the shaft core of the shaft portion 550 is further restrained. This construction can contribute to further promoting reliability of the sealing means 509 provided at the vicinity of the shaft portion 550 and promotion of durability of the bearing 506 rotatably supporting the shaft portion 550 can also be achieved. Further, the rotational number of the pulley member 504 generally falls in a range of 700 through 10000 rpm. Although, the rotational number differs by operating situations of the internal combustion engine 501 (in starting, in operating at high speed).

Further, according to the embodiment, as described above, in comparison with the case in which the central boss portion of the rotating blade member is fitted to the outer portion of the shaft portion of the pulley member, the axial length of the shaft portion 550 can be shortened and, therefore, the construction can contribute to shifting the gravitational center of the rotating blade member 508 to the side of the bearing 506 in the axial length direction of the shaft portion 550 and is advantageous in rotating smoothly the rotating blade member 508.

Further, according to the embodiment, the second erected wall portion 526 of the cylindrical portion 521 of the body 502 is provided to the axial end 506*a* of the bearing 506 as the stopper to thereby ensure the holding performance and the detachment preventive performance with regard to the bearing 506.

Further, as shown by FIG. 5, the double wall structure is constructed by the peripheral wall of the shaft portion 550 and the peripheral wall of the pipe body 582 of the rotating blade member 508 and, therefore, the construction is advantageous in strengthening the shaft portion 550.

In this case, hardening of the peripheral wall of the shaft portion 550 subjected to squeeze-drawing and the pipe body 582 of the rotating blade member 508 subjected to squeeze-drawing can be expected, and the construction is a further advantage to the strengthening of the peripheral wall of the shaft portion 550.

As described above, according to the embodiment, the shaft portion 550 is constructed by the cylindrical shape penetrating in the axial length direction and is constructed by the unbottomed hollow shape which is not provided with the bottom wall portion and, therefore, the drawability is excellent. Therefore, even when the axial length dimension of the shaft portion 550 is set to be long, the construction is advantageous in drawing the shaft portion 550 without hindrance, as well as in the case of adopting a design structure of setting the axial length of the shaft portion 550 to be longer by various situation.

(Sixth Embodiment)

An explanation will be given of a sixth embodiment of the invention in reference to FIG. 6 as follows. The sixth embodiment is provided with a construction basically similar to that of the fifth embodiment and achieves basically the same as those of the fifth embodiment. Portions common to those of the fifth embodiment are provided with common notations.

An explanation will be given centering on different portions as follows. Also according to the embodiment, a pulley member 604 is provided with a pulley portion 640 rotated by a belt 649 constituting a wrapping transmission member and a shaft portion 650 integral with the pulley portion 640. The shaft portion 650 is formed by squeeze-drawing to form a shape of a hollow cylinder penetrated in the axial length direction and is provided with a shaft hollow chamber 651, a front end opening 652 disposed on the front end side of the shaft hollow chamber 651 and a base end opening 653 disposed on the base end side of the shaft follow chamber 651.

In this way, the shaft portion 650 is formed by a cylindrical shape penetrated in the axial length direction and is constructed by an unbottomed hollow shape which is not provided with a bottom wall portion and accordingly, drawability (deep drawability) of the shaft portion 650 of the pulley member 604 is ensured.

Further, also according to the embodiment, a central boss portion 680 of a rotating plate member 608 is fitted to an inner portion of the shaft hollow chamber 651 of the shaft portion 650 of the pulley member 604 and in comparison with the case in which the central boss portion 680 of the rotating blade member 608 is fitted to an outer portion of the shaft portion 650 of the pulley member 604, shortening of an axial length of the shaft portion 650 can be achieved.

Also in this regard, drawability of the shaft portion 650 is ensured. Thus, unlike the case in which the central boss portion of the rotating blade member is fitted to the outer portion of the shaft portion of the pulley member, as shown by FIG. 12 according to the conventional technology, the degree to which a front end 650*p* extends in the axial length direction of the shaft portion 650 to the side of the rotating blade member 608, that is, to the side of a pump chamber 611, is reduced and the front end 650*p* in the axial length direction of the shaft portion 650 may not be extend excessively to the side of the pump chamber 611 such that the front end 605*p* extends into the pump chamber 611 by a larger amount.

Therefore, according to the embodiment, even when a drawing condition is severe, uniform formation of a wall thickness of a peripheral wall of the shaft portion 650 formed by drawing is further achieved. As a result, even when the pulley member 604 is rotated, particularly, even when the pulley member 604 is rotated at high speed, balanced formation of the rotational balance is further promoted in the shaft portion 650 of the pulley member 604.

When the balanced formation of the rotational balance is further promoted and deflection of the shaft core of the shaft portion 650 of the pulley member 604 is further restrained, the construction can contribute to further promoting reliability of sealing means 609 at a vicinity of the shaft portion 650 and further promotion of durability of a bearing 606 rotatably supporting the shaft portion 650 can be achieved.

A body 602 is formed by pressing or form-rolling one sheet of a plate member made of metal. As shown by FIG. 6, the body 602 is provided with an attaching flange portion 620 provided to an attaching face 613 of a cylinder block 610 via a seal portion 614 in a ring-like shape and a cylindrical portion 621 formed at a central region of the attaching flange portion 620.

The cylindrical portion 621 is provided with a first cylindrical portion 622 along the axial length direction, a second cylindrical portion 623 along the axial length direction having a diameter set to be smaller than a diameter of the first cylindrical portion 622, a third cylindrical portion 624 along the axial length direction having a diameter set to be smaller than the diameter of the second cylindrical portion 623, a first erected wall portion 625 along a direction orthogonal to the axial direction for connecting the first cylindrical portion 622 and the second cylindrical portion 623 and a second erected wall portion 626 along the direction orthogonal to the axial direction for connecting the second cylindrical portion 623 and the third cylindrical portion 624.

The body 602 is provided with a first curved portion 631 for promoting holding performance of the bearing 606 provided to an axial end 606*a* of the bearing 606 (side opposed to the cylinder block 610 of an internal combustion engine 601) as a stopper. The first curved portion 631 is formed by curving the second erected wall portion 626. Thus, as shown by FIG. 6, the second cylindrical portion 623, the second erected wall portion 626 and the third cylindrical portion 624, form a substantially S-like shape in a cross-section along the axial length direction of the shaft portion 650 and form the first curved portion 631 provided to the axial end 606*a* of the bearing 606.

Figure 6:
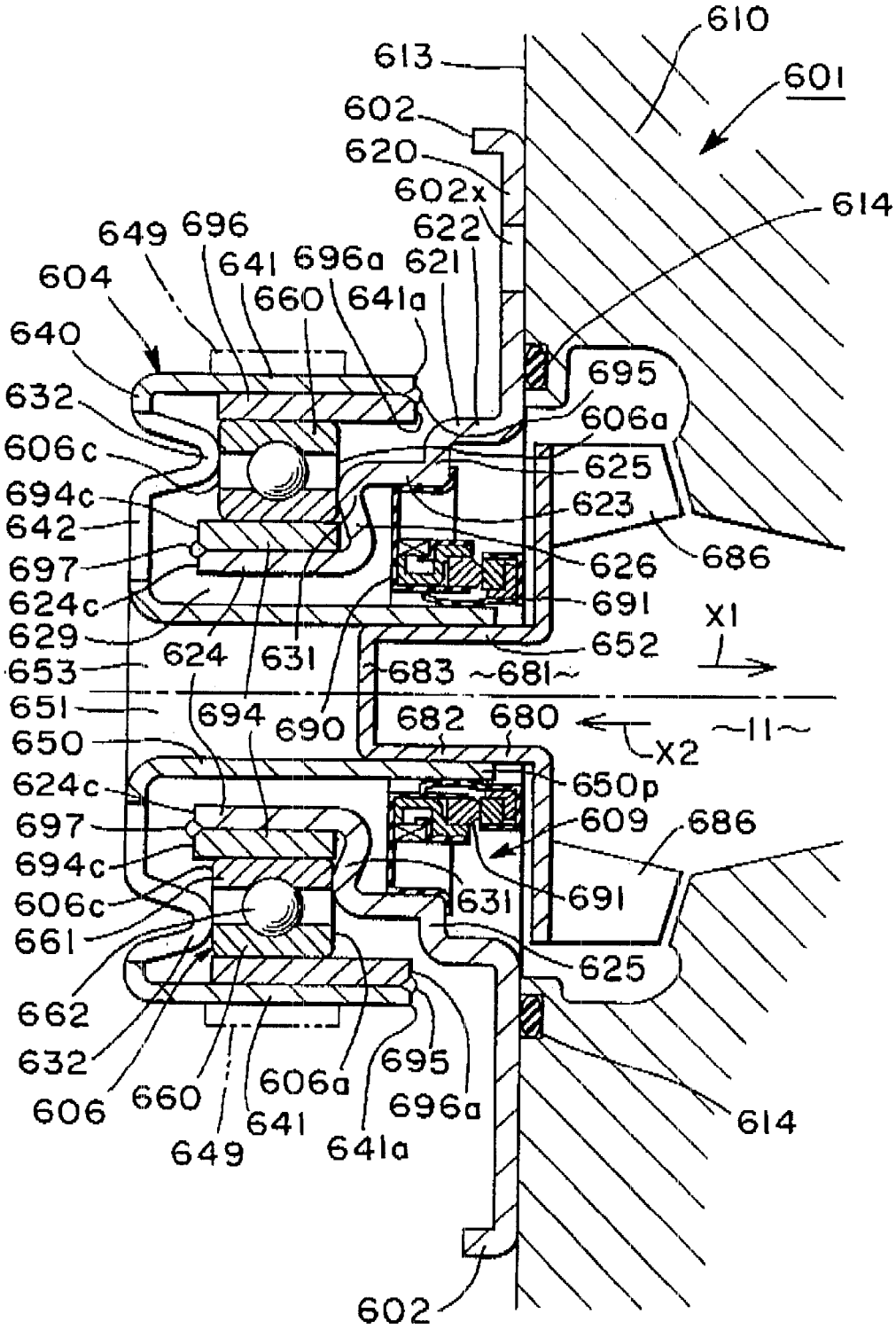
FIG. 6 is a sectional view of a water pump according to a sixth embodiment.

As shown by FIG. 6, the pulley portion 640 of the pulley member 604 is provided with a second curved portion 632 provided to an axial end 606*c* (side reverse to the cylinder block 610 of the internal combustion engine 601) of the bearing 606 as a stopper for promoting holding performance of the bearing 606. The second curved portion 632 is formed by curving an erected wall portion 642 of the pulley potion 640. In other words, the erected wall portion 642 of the pulley portion 640 is provided with a portion constituting substantially a C-like shape or a V-like shape in a section along the axial length direction of the shaft portion 650 and forms the second curved portion 632 provided to the axial end 606*c* of the bearing 606. Therefore, detachment preventive performance of the bearing 606 is promoted.

Further, between the third cylindrical portion 624 of the cylindrical portion 621 of the body 602 and an inner ring 661 of the bearing 606, an inserted member 694 on an inner side forming a cylindrical shape is inserted substantially coaxially. Also between an outer ring portion 641 of the pulley portion 640 and an outer ring 660 of the bearing 606, an inserted member 696 on an outer side forming a cylindrical shape is inserted substantially coaxially.

When the inserted member 696 on the other side and the inserted member 694 on the inner side are inserted in this way, the construction is advantageous in achieving adjustment of respective diameter sizes of the bearing 606, the pulley portion 640 and the body 602. Further, the inserted member 694 on the inner side and the inserted member 696 on the outer side are provided with high rigidity and, therefore, the construction is advantageous in supplementing rigidity of the outer ring portion 641 of the pulley portion 640 and rigidity of the third cylindrical portion 624 of the body 602, and the promotion of strength of integrating the water pump can be achieved.

Further, according to the embodiment, interference between the inserted member 696 on the other side of the bearing 606 is set to be comparatively large and interference between the inserted member 694 on the inner side and the bearing 606 is also set to be comparatively large. Further, interference between the inserted member 696 on the outer side and the outer ring portion 641 of the pulley member 604 is set to be comparatively small and interference between the inserted member 694 on the inner side and the body 602 is also set to be comparatively small.

In FIG. 6, an arrow mark X1 indicates a direction from the outside to an inner portion of the internal combustion engine 601 in the axial length direction of the shaft portion 650, and an arrow mark X2 indicates a direction remote from the inner portion of the internal combustion engine 601 to outside in the axial length direction of the shaft portion 650. An axial end 696*a* of the side of the internal combustion engine 601 of the inserted member 696 on the outer side is projected in the arrow mark X1 direction more than the axial end 606*a* of the bearing 606. Also, an axial end 641*a* of the outer ring portion 641 of the pulley portion 640 is projected in the arrow mark X1 direction to be remote from the bearing 606.

Further, the axial end 696*a* of the inserted member 696 on the outer side and the axial end 641*a* of the outer ring portion 641 of the pulley portion 640 projected in the arrow mark X1 direction to be remote from the bearing 606, described above, are connected by a welded portion 695. Therefore, the welded portion 695 can be remote from bearing 606 and the construction is advantageous in alleviating or avoiding any thermal effects on the resulting bearing 606 from welding and can contribute further to the reliability of the bearing 606.

As shown by FIG. 6, an axial end 694*c* (side reverse to the cylinder block 610 of the internal combustion engine 601) of the inserted member 694 on the inner side, is projected in a direction remote from the bearing 606, that is, in the arrow mark X2 direction. Also, an axial end 624*c* (side reverse to the cylinder block 610 of the internal combustion engine 601) of the third cylindrical portion 624 of the cylindrical portion 621 of the body 602, is projected in the arrow mark X2 direction to be remote from the bearing 606.

The axial end 694*c* of the inserted member 694 on the inner side projected in the arrow mark X2 direction to be remote from the bearing 606 and the axial end 624*c* of the third cylindrical portion 624 of the cylindrical portion 621 of the body 602, described above, are connected by a welded portion 697. Therefore, the welded portion 697 can be remote from the bearing 606 and the construction is advantageous in alleviating or avoiding any thermal effects on the bearing 606 resulting from welding and can further contribute to the reliability of the bearing 606.

In recent years, a greater level of reliability in the belt 649 is more and more sought after. The outer ring portion 641 of the pulley portion 640 is hung with the belt 649 and, therefore, when strain is caused at the outer ring portion 641 of the pulley portion 640, the construction is not the preferable choice in trying to achieve greater reliability in the belt 649.

In this respect, as shown by FIG. 6, according to the embodiment in which the welded portion 695 is formed at the axial end 641*a* projected in the arrow mark X1 direction in the outer ring portion 641 of the pulley portion 640, the construction is advantageous in minimizing strain on the outer ring portion 641 of the pulley portion 640 during welding; further, the welded portion 695 can be as remote as possible from the belt 649 hung on an outer peripheral face of the outer ring portion 641.

Therefore, the belt 649 is prevented from being hung at a thermally affected portion of welding, which is advantageous in promoting the reliability of the belt 649. Further, in place of the welded portions 695 and 697, the inserted member 694 on the inner side and the body 602 may be connected by caulked portions or bolts, and the inserted member 696 on the outer side and the pulley member 604 may be connected thereby.

As shown by FIG. 6, the rotating blade member 608 is provided with the central boss portion 680 subjected to deep drawing and a plurality of blades 868 integrally held by the central both portion 680. The central boss portion 680 is disposed on a side reverse to the blades 686 in the axial length direction of the shaft portion 650.

The central boss portion 680 of the rotating blade member 608 is constructed by a bottomed hollow shape and is provided with a pipe body 682 having a hollow chamber 681 and a closed wall 683 for closing a front end side of the hollow chamber 681 of the pipe body 682. The central boss portion 680 provided on the side reverse to the blades 686 of the rotating blade member 608, is fixedly press-fitted to the inner portion of the shaft hollow chamber 651 of the shaft portion 650 of the pulley member 604.

In other words, an outer wall face of the pipe body 682 of the central boss portion 680 of the rotating blade member 608, is press-fitted to an inner wall face partitioning the shaft hollow chamber 651 of the shaft portion 650 of the pulley member 604. The closed wall 683 of the central boss portion 680 of the rotating blade member 608, closes to bring the shaft hollow chamber 651 in a communicated state of the shaft portion 650 of the pulley member 604 into a non-communicated state to thereby prevent water in the pump chamber 611 from leaking to the shaft hollow portion 651 of the shaft portion 650.

Further, the hollow chamber 681 of the pipe body 682 of the rotating blade member 608 is opposed to the pump chamber 611.

(Seventh Embodiment)

A specific explanation will be given of a seventh embodiment of the invention in reference to FIG. 7 as follows. The seventh embodiment is provided with a construction basically similar to that of the fifth embodiment, and operation and effect specifically similar to those of the fifth embodiment are achieved. Notations common to those of the fifth embodiment are attached with common notations.

An explanation will be given centering on different portions as follows. Also according to the embodiment, a pulley member 704 is provided with a pulley portion 740 rotated by a belt 749 constituting a wrapping transmission member and a shaft portion 750 integral with the pulley portion 740. The shaft portion 750 is constructed by a cylindrical shape penetrated in the axial length direction and is provided with a shaft hollow chamber 751, a front end opening 752 disposed on a front end side of the shaft hollow chamber 751 and a base end opening 753 disposed on a base end side of the shaft hollow chamber 751.

In this way, the shaft portion 750 is constructed by the cylindrical shape penetrated in the axial length direction and is constructed by an unbottomed hollow shape which is not provided with a bottom wall portion and, therefore, drawability of the shaft portion 750 of the pulley member 704 is ensured.

Further, also according to the embodiment, a central boss portion 780 of a rotating blade member 708 is fitted to an inner portion of the shaft hollow chamber 751 of the shaft portion 750 of the pulley member 704 and can achieve shortened formation of axial length of the shaft portion 750 in comparison with the case in which the central boss portion 780 of the rotating blade member 708 is fitted to an outer portion of the shaft portion 750 of the pulley member 704.

Also in this regard, the drawability (deep drawability) of the shaft portion 750 is ensured. Thus, the central boss portion 780 of the rotating blade member 708 can be arranged to be directed the pulley portion 740, that is, in an arrow mark X2 direction of FIG. 7 and accordingly, different from the case in which the central boss portion of the rotating blade member is fitted to the outer portion of the shaft portion of the pulley member as shown by FIG. 12 according to the conventional technology; a projecting degree for projecting a front end 750*p* in the axial length direction of the shaft portion 750 to a side of the rotating blade member 708, that is, to a side of a pump chamber 711, is reduced and the front end 750*p* in the axial length direction of the shaft portion 750 may not be projected excessively into the pump chamber 711.

Therefore, even when the drawing condition is severe, nonuniformity of wall thickness at a peripheral wall of the shaft portion 750 formed by drawing can be minimized. As a result, even when the pulley member 704 is rotated, particularly, even when the pulley member 704 is rotated at high speed, further balanced formation of rotational balance of the shaft portion 750 of the pulley member 704 can be achieved and the construction can contribute to further promoting reliability of a mechanical seal in the vicinity of the shaft portion 750 and can also achieve further promotion of durability of a bearing 706 rotatably supporting the shaft portion 750.

A body 702 is formed by pressing or form-rolling one sheet of a plate member made of metal. The body 702 is provided with an attaching flange portion 720 provided at an attaching face 713 of a cylinder block 710 via a seal portion 714 in a ring-like shape and a cylindrical portion 721 formed at a central region of the attaching flange portion 720.

The cylindrical portion 721 is constructed by a shape of a stepped cylinder and is provided with a first cylindrical portion 722 along an axial length direction, a second cylindrical portion 723 along the axial length direction having a diameter set to be larger than a diameter of the first cylindrical portion 722, a third cylindrical portion 724 along the axial length direction having a diameter set to be smaller than the diameter of the second cylindrical portion 723, a first erected wall portion 725 along a direction orthogonal to the axial direction for connecting the first cylindrical portion 722 and the second cylindrical portion 723 and a second erected wall portion 726 along the direction orthogonal to the axial direction for connecting the second cylindrical portion 723 and the third cylindrical portion 724.

The second cylindrical portion 723, the first erected wall portion 725 and the second erected wall portion 726 form a drain chamber 735. Even when water in the pump chamber 711 passes through sealing means 709, the water is stored in the drain chamber 735 of the body 702. Water excessively stored in the drain chamber 735 is discharged from a drain hole 736 of the second erected portion 726 of the body 702.

Figure 7:
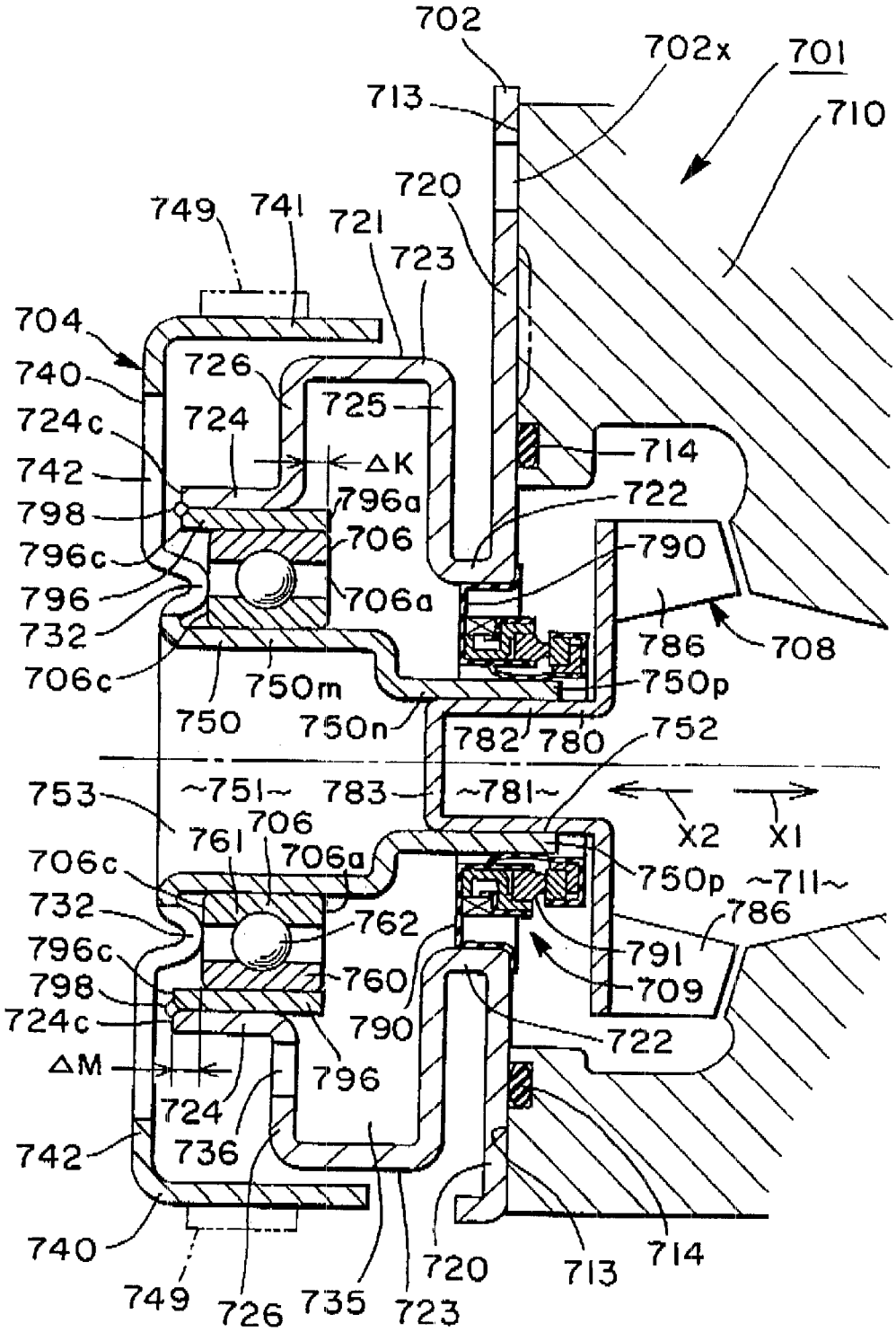
FIG. 7 is a sectional view of a water pump according to a seventh embodiment.

According to the embodiment, as shown by FIG. 7, an inner peripheral face of the bearing 706 is opposed to the shaft portion 750 and an outer peripheral face of the bearing 706 is opposed to the third cylindrical portion 724 of the body 702 via an inserted member 796. The shaft portion 750 of the pulley member 704 is constructed by a structure of a shaft having plural steps having a plurality of diameters (inner diameter, outer diameter). Thus, the shaft portion 750 is provided with a first shaft portion 750*m* having a large diameter and a second shaft portion 750*n* coaxial therewith having a diameter set to be smaller than the diameter of the first shaft portion 50*m*.

In this way, the shaft portion 750 is constructed by a cylindrical shape having a plurality of steps and, therefore, the diameter of the shaft portion 750 can be drawn to squeeze in steps from a large diameter to a small diameter, the squeeze-drawability of the shaft portion 750 is further improved and also the case of setting the axial length of the shaft portion 750 to be long is easy to deal with.

Therefore, as shown by FIG. 7, the front end 750*p* of the shaft portion 750 reaches the attaching face 713 of the cylinder block 710 of an internal combustion engine 701 in the arrow mark X1 direction and reaches inside of the pump chamber 711 of the cylinder block 710 of the internal combustion engine 701. However, the invention is not limited thereto but the front end of the shaft portion 750 may not reach the attaching face 713 of the cylinder block 710 of the internal combustion engine 701 in the arrow mark X1 direction.

The bearing 706 in a ring-like shape is provided between the first shaft portion 750*m* having a diameter larger than the diameter of the second shaft portion 750*n* and the third cylindrical portion 724 of the body 702. Therefore, even a case in which the size of the diameter of the bearing 706 is large can thus be dealt with. Further, when the size of the diameter of the bearing 706 is large, the construction is advantageous in promotion of reliability and longevity of the bearing 706.

As shown by FIG. 7, the pulley portion 740 of the pulley member 704 is provided with a second curved portion 732 provided to an axial end 706*c* (side reverse to the cylinder block 710 of the internal combustion engine 701) of the bearing 706 as a stopper for promoting holding performance of the bearing 706. The second curved portion 732 is formed by curving an erected wall portion 742 of the pulley portion 740. In other words, the erected wall portion 742 of the pulley portion 740 is provided with a portion constituting substantially a C-like shape or a V-like shape in a section along the axial length direction of the shaft portion 750 and forms the second curved portion 732 provided to the axial end 706*c* of the bearing 706 as the stopper. Therefore, detachment preventive performance of the bearing 706 is enhanced.

As shown by FIG. 7, between the third cylindrical portion 724 of the body 702 and an outer ring 760 of the bearing 706, an inserted member 796 constituting a cylindrical shape is inserted substantially coaxially therewith. When the inserted member 796 is inserted thereinto in this way, the construction is advantageous in achieving adjustment of respective diameter sizes of the bearing 706 and the body 702.

Further, the construction is also advantageous in supplementing rigidity of the third cylindrical portion 724 of the cylindrical portion 721 of the body 702. An axial end 724*c* of the third cylindrical portion 724 of the body 702 on the side of the erected wall portion 742 of the pulley portion 740, is projected from the bearing 706 in an arrow mark X2 direction by ΔM (as shown in to FIG. 7).

An axial end 796*c* of the inserted member 796 on the side of the erected wall portion 742 of the pulley portion 740 is projected from the bearing 706 in the arrow mark X2 direction by ΔM (refer to FIG. 7). The axial end 796*c* of the inserted member 796 and the axial end 724*c* of the third cylindrical portion 724 of the body 702 projected from the bearing 706 in the arrow mark X2 direction in this way, are connected by a welded portion 798. By constituting in this way, the welded portion 798 can be remote from the bearing 706 and the construction can contribute to promotion of reliability of the bearing 706 and can achieve greater durability of the bearing 706.

Further, as shown by FIG. 7, the axial length of the inserted member 796 in the cylindrical shape is set to be longer than the axial length of the third cylindrical portion of the body 702. Therefore, an axial end 796*a* of the inserted member 796 on the side of the internal combustion engine 701 in the inserted member 796, is projected from the third cylindrical portion 724 of the body 702 by ΔK (as shown in to FIG. 7) to a side of the rotating blade member 708, that is, in the arrow mark X1 direction in the axial length direction of the shaft portion 701.

By utilizing the portion of the axial end 796*a* of the inserted member 796 projected in the arrow mark X1 direction in this way, a side of an axial end 706*a* of the bearing 706 is held. Therefore, the construction is advantageous in approaching the bearing 706 to the side of the rotating blade member 708, that is, in the arrow mark X1 direction and can contribute to shortened formation of an axial length dimension of the water pump.

Further, in place of the welded portion 798, the inserted member 796 and the body 702 may be connected by a caulked portion.

The rotating blade member 708 is provided with the central boss portion 780 subjected to deep drawing and a plurality of blades 786 integrally held by the central boss portion 780. The central boss portion 780 is disposed on a side reverse to the blades 786 in the axial length direction of the shaft portion 750.

The central boss portion 780 of the rotating blade member 708 is constructed by a bottomed hollow shape and is provided with a pipe body 782 having a hollow chamber 781 and a closed wall 783 for closing a front end side of the hollow chamber 781 of the pipe member 782. The central boss portion 780 provided on the side reverse to the blades 786 of the rotating blade member 708, is fixedly press-fitted to an inner portion of the shaft hollow chamber 751 of the shaft portion 750 of the pulley member 704.

In other words, an outer wall face of the central boss portion 780 of the rotating blade member 708 is press-fitted to an inner wall face partitioning the shaft hollow chamber 751 of the shaft portion 750 of the pulley member 704. The closed wall 783 of the central boss portion 780 of the rotating blade member 708, closes the shaft hollow chamber 751 of the shaft portion 750 of the pulley member 704 and prevents water in the pump chamber 711 from leaking to the shaft hollow chamber 751 of the shaft portion 750.

Further, the hollow chamber of the pipe body 782 of the rotating blade member 708 is opposed to the pump chamber 711.

Although according to the above-described embodiment, the central boss portion provided on the side reverse to the blades of the rotating blade member is fixedly press-fitted to the inner portion of the shaft hollow chamber of the shaft portion of the pulley member, the central boss portion may not necessarily be fixedly press-fitted thereto but may be fixed thereto by welding or by mechanical caulking. Although the above-described embodiment is applied to the water pump for delivering and feeding water mounted to the internal combustion engine of a vehicle, the embodiment is applicable also to a water pump for delivering and feeding water mounted to other engines.

(Eighth Embodiment)

Figure 8:
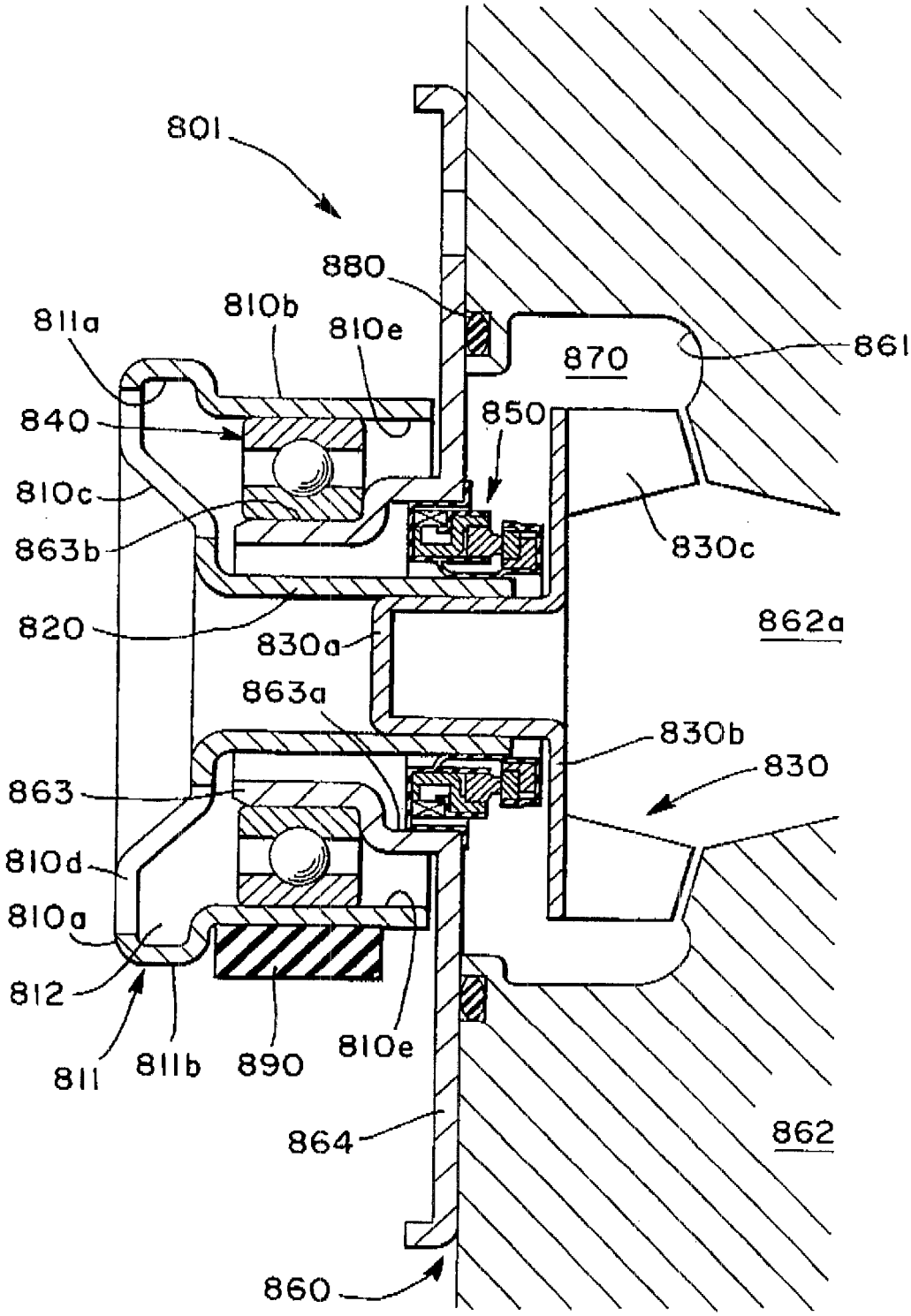
FIG. 8 is a sectional view of a water pump showing an eighth embodiment of the invention.

FIG. 8 is a sectional view showing an eighth embodiment of applying the invention to a water pump of an engine.

In FIG. 8, a water pump 801 is constructed by a pulley 810, an impeller 830, a bearing 840, a shaft sealing member (shaft seal) 850, a housing (body) 860 and a seal member 880.

The pulley 810 is provided with substantially a bottomed cylindrical shape in which an end face on one side (right side of illustration) thereof is opened and which is provided with an end face 810*a* on other side (left side of illustration).

A cylindrical face of the pulley 810 is formed with a projected portion 811 projected outwardly in the diameter direction over an entire periphery thereof at the end face 810*a* (side in the axial direction of the pulley), the diameter of the cylindrical face is contracted and the pulley 810 is formed with a cylindrical face 810*b* extended to the one side and constituting an engaging face of a belt.

Figure 9:
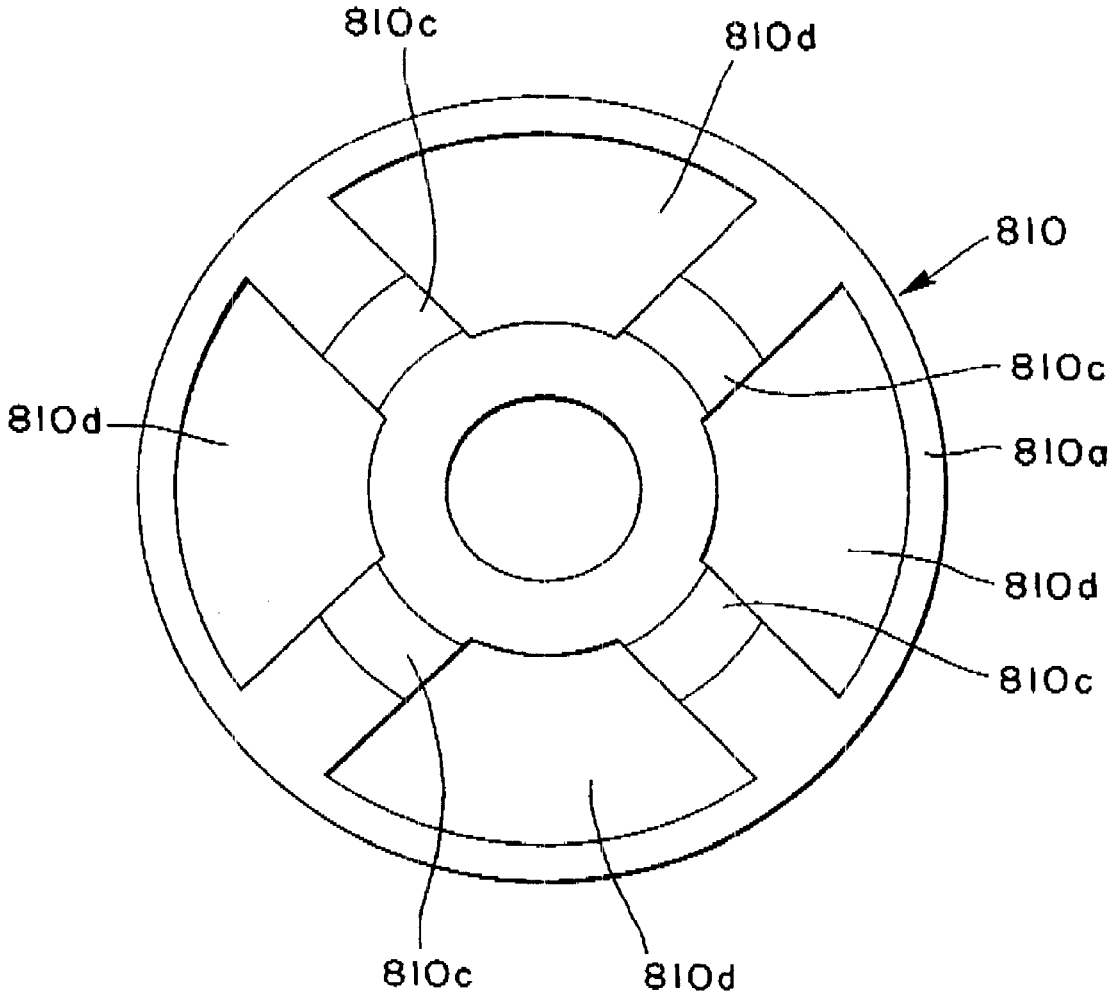
FIG. 9 is a front view of the water pump showing the eighth embodiment of the invention.

Further, the end face 810*a* is provided with a stepped portion 810*c* in the vicinity of a center of which is projected to the one side in a conical shape and a shaft portion (shaft) 820 constructed by further projecting the vicinity of the center of the stepped portion 810*c* to the one side in a cylindrical shape. Notched portions (communicating holes) 810*d* as shown by FIG. 8 and FIG. 9 are formed between the stepped portions 810*c* and the end face 810*a* for communicating inside and outside of the pulley.

Here, all of the stepped portions 810*c*, the shaft portion 820, the projected portion 811 and the belt engaging face 810*b* are formed concentrically with the pulley 810.

The pulley 810 may be formed by pressing a plate-like member such as a steel plate subjected to a corrosion resistant processing or the pulley 810 may be formed by a steel plate and subjected to the corrosion resistant processing after forming. For example, a body portion 864 of the body or housing 860 is formed by pressing or form-rolling process from one sheet of a metal plate member. The pulley 810 having a shaft portion 820 in a shape of a hollow cylinder is formed from one sheet of a metal plate member by a pressing and/or squeezing process.

The impeller 830 is an open type impeller having a base portion 830*b* in a shape of a circular disk and several sheets of blades 830*c* projected therefrom. At center of the base portion 830*b* of the impeller 830, there is formed a projected portion 830*a* for inserting to an inner peripheral face of the shaft portion 820. According to the embodiment, the projected portion 830*a* and the shaft portion 820 are attached to each other unrotatably relative to each other by press-fitting to thereby ensure liquid tightness between a liquid in the housing 860 and outside.

The housing 860 is constructed by a main body portion 862 having an intake portion 862*a*, a delivery port, not illustrated, and a recess portion 861 and a body bottom portion 864 attached to an end face of the main body portion 862. The main body portion 862 may be formed by, for example, an aluminum die-cast product or may be constructed integrally with a cylinder block or a timing belt case of an engine.

The body bottom portion 864 is formed substantially in a shape of a circular disk and in the vicinity of a center thereof, there is formed a cylindrical portion 863 having a diameter smaller than an outer diameter of the body bottom portion 864 to project in a direction separating from the main body portion 862. The body bottom portion 864 is formed by pressing a plate-like member such as a steel plate subjected to a corrosion resistant processing. The main body portion 862 and the body bottom portion 864 are coupled by bolts, not illustrated, via the seal member 880. Therefore, there is formed a space maintaining liquid tightness between the recess portion 861 of the main body portion 862 and the body bottom portion 864.

The space constitutes a water chamber 870 and the impeller 830 is arranged in the water chamber 870.

An inner peripheral face 863*a* of the cylindrical portion 863 of the body bottom portion 864, is attached with an outer peripheral face of an shaft sealing member 850 unrotatably relative to each other by press-fitting. Further, an outer peripheral face of the shaft portion 820 is attached with an inner peripheral face of the shaft sealing member 850 unrotatably relative to each other similarly by press-fitting. Here, the inner and the outer peripheral faces of the shaft sealing member 850 are made rotatable relative to each other. The shaft sealing member 850 is a publicly-known mechanical seal.

Further, an outer peripheral face 863*b* of the cylindrical portion 863 of the body bottom portion 864 is attached with an inner ring of the bearing 840 unrotatably relative to each other by press-fitting. Meanwhile, an inner peripheral face 810*e* of the belt engaging face 810*b* of the pulley 810, is attached with an outer ring of the bearing 840 unrotatably relative to each other by press-fitting. Here, the bearing 840 is a publicly-known rolling bearing.

Therefore, the pulley 810 is supported by the bearing 840 rotatably relative to the housing 860.

Next, an explanation will be given of operation of the eighth embodiment.

The pulley 810 is rotated by rotational force transmitted from an output shaft of an engine, not illustrated, via a belt 890 engaged with the belt engaging face 810*b* of the pulley 810. With rotation of the pulley 810, the shaft portion 820 integrally formed with the pulley 810 is rotated also in the same direction. Further, the impeller 830 integrated with the shaft portion 820 is rotated in the water chamber 870 in the housing 860.

Now, coolant is filled in the water chamber 870 and, therefore, by centrifugal force produced by rotating the impeller 830, the impeller 830 delivers the coolant disposed in the vicinity of a center of the water chamber 870 in an outer peripheral direction of the impeller 830. In this way, there is produced a pumping operation by the centrifugal force from the center of the impeller to the outer side. Therefore, there is produced a pressure difference between the vicinity of the rotational center and the outer peripheral side of the impeller 830 in the water chamber 870 and the coolant is sucked from the intake portion 862*a* provided in the vicinity of the rotational center of the impeller 830 to inside of the water chamber 870.

Further, the coolant is pressurized to the outer peripheral side by the pumping operation of the impeller 830 and supplied from the delivery port, not illustrated, provided on the outer peripheral side to respective portions to be cooled of the engine.

Whereas inside of the water chamber 870 is filled with the coolant, the pulley 810 is opened to the atmosphere via the notched portions 810*d*. However, an interval between the main body portion 862 and the body bottom portion 864 is hermetically sealed by the seal member 880 and an interval between the shaft portion 820 and the body bottom portion 864 is hermetically sealed by arranging the shaft sealing member 850.

As described above, according to the eighth embodiment, the shaft sealing member 850 is arranged between the inner peripheral face 863*a* of the cylindrical portion 863 of the body bottom portion 864 and the outer peripheral face of the shaft portion 820 of the pulley 810. Very small leakage of the coolant may be caused in the shaft sealing member 850 as its characteristic.

For example, when the coolant is leaked at the shaft sealing member 850 in the stationary state of the engine, the leaked coolant passes between the shaft portion 820 and the inner peripheral face 863*a* of the cylindrical portion 863 and reaches an inner space 812 partitioned in a ring-like shape by the inner peripheral face 810*e* of the belt engaging face 810*b* of the pulley 810 and an inner peripheral face 811*a* of the projected portion 811, the end face 810*a* and the stepped portion 810*c*.

As shown by FIG. 8, at the bottom of illustration of the inner space 812 is constructed by the inner peripheral face 810*e* of the belt engaging face 810*b* and the inner peripheral face 811*a* of the projected portion 811. Here, a position in the horizontal direction of illustration of the inner peripheral face 811*a* of the projected portion 811 is formed as the bottom of a position in the horizontal direction of illustration than the inner peripheral face 810*e* of the belt engaging face 810*b*. Therefore, the leaked coolant is stored not in the vicinity of the inner peripheral face 810*e* of the belt engaging face 810*b* of the inner space 812, but rather on the side of the inner peripheral face 811*a* of the projected portion 811.

Meanwhile, the end face 810*a* is provided with the notched portions 810*d* (adjusting means) as shown by FIG. 8 or FIG. 9. At this occasion, the notched portion 810*d* is opened at a position on a lower side (lower) of illustration than the position in the horizontal direction of illustration of the inner peripheral face 810*e* of the belt engaging face 810*b*. Therefore, the leaked coolant is swiftly discharged from the notched portion 810*d* to outside of the pulley 810. The discharge coolant is conducted at the end face 810*a* of the pulley 810 and is dropped from an outer peripheral face 811*b* of the projected portion 811.

On this occasion, the projected portion 811 is projected to the outer side in the diameter direction over its entire periphery at the side of the pulley 810 in the axial direction and, therefore, the coolant does not reach the cylindrical face (belt engaging face) 810*b* by way of the projected portion 811. Therefore, a deterioration of a rubber member of the belt (swelling or lowering of strength) or adverse influence by a dried substance of a component of the coolant adhered to the belt is not effected and, therefore, extension of life of the belt can be achieved.

Further, there can be prevented slippage caused by reducing friction force between the belt engaging face and the belt by entering of the coolant and, therefore, there can also be prevented occurrence of loss of pump driving torque and occurrence of wear of the belt by slipping the belt.

Further, although the bearing 840 is arranged between the inner peripheral face 810*e* of the belt engaging face 810*b* of the pulley 810 and the outer peripheral face 863*b* of the cylindrical portion 863, the coolant is not stored in the vicinity of the bearing but is stored at the projected portion 811 by the projected portion 811. Therefore, there is no concern for an invasion of the leaked coolant to the inside of the bearing 840. Therefore, a deterioration of grease of the bearing or occurrence of corrosion inside the bearing can be prevented and, therefore, promotion of life of the bearing can be achieved.

(Ninth Embodiment)

Figure 10:
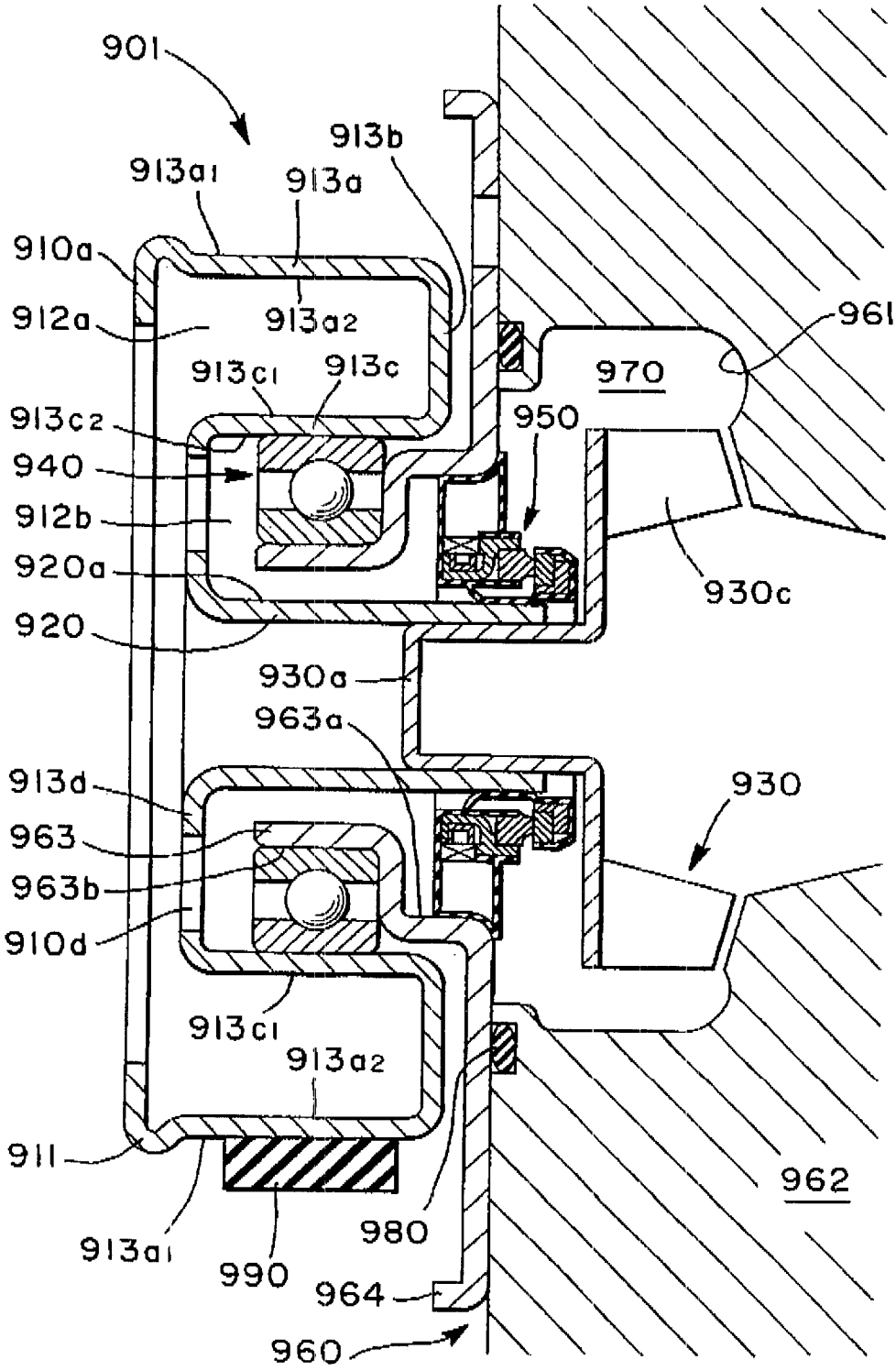
FIG. 10 is a sectional view of a water pump showing a ninth embodiment of the invention.

FIG. 10 is a sectional view showing a ninth embodiment applying the invention to a water pump of an engine. Further, the ninth embodiment differs from the eighth embodiment only in a construction of a pulley and, therefore, numeral notations constructed by attaching 900 to numeral notations of the eighth embodiment are attached with regard to a construction the same as that of the eighth embodiment and an explanation is unnecessary.

In FIG. 10, a water pump 901 is constructed by a pulley 910, an impeller 930, a bearing 940, a shaft sealing member 950, a housing 960 and a seal member 980.

The pulley 910 is constructed by a first end face (first ring-like face) 913*b* formed by bending, by right angle, a cylindrical face (first cylindrical face 913*a*) substantially in a bottomed cylindrical shape an end face on one side of which is opened and which is provided with an end face 910*a* on the other side, on the one side, a second cylindrical face 913*c* formed by bending, by right angle, the first end face 913*b* and extending the face to other side, a second end face (second ring-like face) 913*d* formed by bending, by right angle, the second cylindrical face 913*c* on the other side and a shaft portion (third cylindrical face 920) in a cylindrical shape formed by bending, by right angle, the second end face 913*d* and extending the face to the one side.

A belt 990 is engaged with an outer peripheral face 913*a*1 of the first cylindrical face 913*a* and the outer peripheral face 913*a*1 of the first cylindrical face 913*a* functions as a belt engaging face of the pulley 910. A first ring-like space 912*a* (first space) having a section in a channel-like shape projected to the one side of the pulley 910, is partitioned by an inner peripheral face 913*a*2 of the first cylindrical face 913*a* of the pulley 910, the other end face 910*a* of the pulley 910, the first end face 913*b* and an outer peripheral face 913*c*1 of the second cylindrical face 913*c*.

Figure 11:
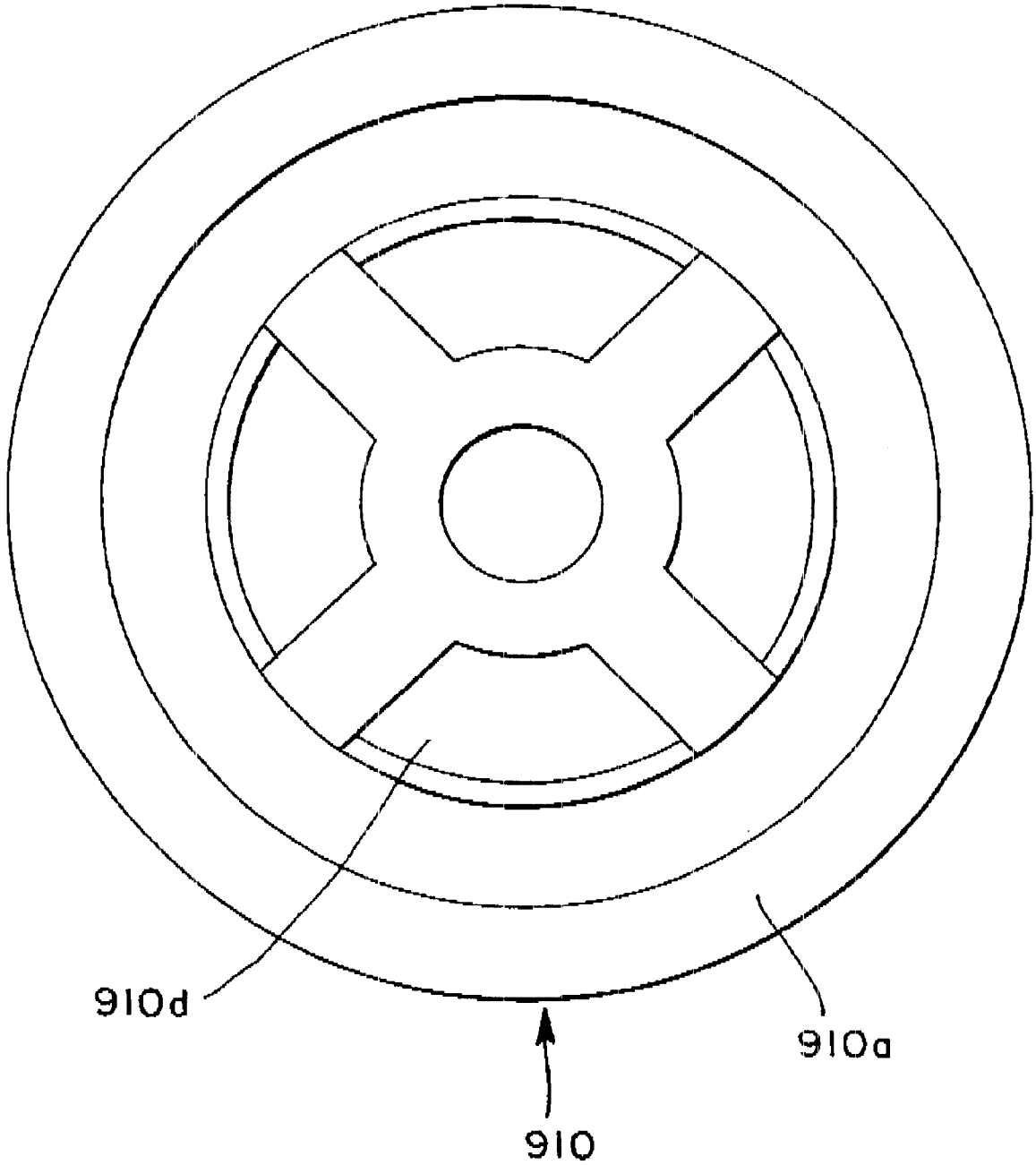
FIG. 11 is a front view of the water pump showing the ninth embodiment of the invention.

The end face 910*a* of the pulley 910 is a ring-like face orthogonal to the first cylindrical face 913*a* as shown by FIG. 11, provided by a predetermined length to the center and is opened thereafter.

Further, there is formed a projected portion 911 produced by projecting the first cylindrical face 913*a* to an outer side in the diameter direction over an entire periphery, is formed in a vicinity (side in the axial direction of the pulley 910) of a corner portion produced by the end face 910*a* and the first cylindrical face 913*a* of the pulley 910.

Further, there is partitioned a second ring-like space (second space) 912*b* having a section in a shape of an inverse channel projected to the other side of the pulley 910 by an inner peripheral face 913*c*2 of the second cylindrical face 913*c*, the second end face 913*b* and an outer peripheral face 920*a* of the shaft portion 920. At a corner portion constructed by the second cylindrical face 913*c* and the second end face 912*b*, there is provided a notched portion 910*d* (communicating portion) for communicating the first ring-like space 912*a* and the second ring-like space 912*b*.

Here, all of the first cylindrical face 913*a*, the first end face 913*b*, the second cylindrical face 913*c*, the second end face 913*d*, the first and the second ring-like spaces 912*a* and 912*b* and the shaft portion 920 are formed concentrically.

The pulley 910 is formed by forming a plate-like member such as a steel plate subjected to a corrosion resistant processing by plastic deformation such as pressing; or, the pulley 910 may be formed by forming the steel plate by plastic deformation such as pressing and thereafter subjecting the steel plate to corrosion resistant processing.

Further, an inner ring of the bearing 940 is attached to an outer peripheral face 963*b* of a cylindrical portion 963 of the body bottom portion 964 unrotatably relative to each other by press-fitting. An outer ring of the bearing 940 is attached to the inner peripheral face 913*c*2 of the second cylindrical face 913*c* of the pulley 910 unrotatably relative to each other by press-fitting. Here, the bearing 940 is a publicly-known rolling bearing.

Therefore, the pulley 910 is supported by the housing 960 rotatably to each other by the bearing 940.

Next, an explanation will be given of operation of the ninth embodiment.

Similar to the above-described eighth embodiment, the shaft sealing member 950 is arranged between an inner peripheral face 963*a* of the cylindrical portion 963 of the body bottom portion 964 and the outer peripheral face 920*a* of the shaft portion 920 of the pulley 910. Very small leakage of coolant may be caused at the shaft sealing member 950 as its characteristic.

For example, when leakage is caused in the shaft sealing member 950 in the stationary state of the engine, the leaked coolant passes between the shaft portion 920 and the inner peripheral face 963*b* of the cylindrical portion 963 and reaches the second ring-like space 912*b* of the pulley 910. The notched portion (communicating portion) 910*d* is opened on the lower side of the illustration and the left direction of the second ring-like space 912*b* and, therefore, the leaked coolant is conducted to the lower side of illustration via the notched portion 910*d*.

The first ring-like space 912*a* is partitioned at an outer periphery of the second ring-like space 912*b*. The leaked coolant is conducted to the first ring-like space 912*a* via the notched portion 910*d*. Here, the end face 910*a* of the pulley 910 partitioning the first ring-like space 912*a* is extended in a diameter contracting direction by a predetermined length and is opened thereafter. Therefore, the leaked coolant is stored in the first ring-like space 912*a* by a predetermined amount.

When an amount of the coolant leaked from the shaft sealing member 950 becomes larger than the predetermined amount, the leaked coolant rides over the end face 910*a* of the pulley 910 and flows from an opening 910*b* to outside of the first ring-like space 912*a*. The coolant which has flowed outside thereof is conducted at the end face 910*a* of the pulley 910 and flows in the lower direction of illustration.

Further, the coolant reaches the projected portion 911 and is dropped. A position in the horizontal direction of illustration of the outer peripheral face of the projected portion 911 is lower than that of the outer peripheral face 913*a*1 of the first cylindrical face 913*a* and, therefore, the coolant does not reach the outer peripheral face 913*a*1 engaged with the belt 990 by way of the projected portion 911.

Therefore, there is not caused a deterioration (swelling or lowering of strength) of a rubber material of the belt or adverse influence by a dried substance of a component of the coolant adhered to the belt and, therefore, promotion of life of the belt can be achieved.

Further, there can be also prevented occurrence of loss of pump driving torque caused by slippage by reducing frictional force between the engaging face and the belt by entering of the coolant therebetween or wear of the belt by occurrence of belt slippage.

Further, although the bearing 940 is arranged between the cylindrical portion 963 and the inner peripheral face 913*c*2 of the second cylindrical face 913*c* in the second ring-like space 912*b*, by the notched portions 910*d*, the coolant leaked from the shaft sealing member 950 is not stored in the second ring-like space 912*b* but immediately flows to the first ring-like space 912*a*.

Therefore, there is no concern about invasion of the leaked coolant to the inside of the bearing 940. Therefore, corrosion of inside of the bearing or deterioration of grease can be prevented and extension of life of the bearing can be achieved.

As many apparently widely different embodiments of the present invention can be made without departing from the spirit and scope thereof, it is to be understood that the invention is not limited to the specific embodiments thereof except as defined in the appended claims.

What is claimed is:

1. A water pump comprising:

a pulley rotated by receiving a torque from a drive source and having a shaft portion which is integrally formed therewith and extended in a shaft core direction at a central portion thereof;

an impeller fixed to the shaft portion and rotated integrally with the shaft portion;

a body forming a water chamber arranged with the impeller;

a cylindrical portion provided by projecting from the body in a cylindrical shape;

a bearing rotatably supporting the pulley at the cylindrical portion; and a shaft sealing member for sealing the bearing against the water chamber;

wherein the shaft sealing member is attached to either one of an inner peripheral face and an outer peripheral face of the cylindrical portion.

2. The water pump according to claim 1:

wherein the shaft portion includes a hollow chamber, the impeller includes a central boss portion and blades and the central boss portion is fitted to an inner portion or an outer portion of the shaft hollow chamber of the shaft portion.

3. The water pump according to claim 1:

wherein the impeller includes a central boss portion in a bottomed hollow shape having a closed wall and blades projected in a direction reverse to the central boss portion in an axis length direction of the shaft portion, the central boss portion of the impeller is fitted to an inner portion of a shaft hollow chamber of the shaft portion and the shaft hollow chamber of the shaft portion is closed in an uncommunicated state by closed wall.

4. The water pump according to claim 1:

wherein an outer ring of the bearing is attached to an inner peripheral face of the pulley, an inner ring thereof is attached to an outer peripheral face of the cylindrical portion and the shaft sealing member is attached to an inner peripheral face of the cylindrical portion.

5. The water pump according to claim 4:

wherein a portion of the impeller attached to the shaft portion is constituted in a bag-like shape and an end face of the shaft portion on a side fixed to the impeller is opened.

6. The water pump according to claim 5:

wherein the cylindrical portion is provided integrally with a portion constituting a diameter smaller than an outer diameter of the shaft sealing member.

7. The water pump according to claim 5:

wherein the cylindrical portion is integrally provided with a portion constituting a diameter larger than an inner diameter of the bearing.

8. The water pump according to claim 5:

wherein the cylindrical portion is provided with a large diameter portion and a small diameter portion, the bearing is attached to an outer peripheral face of the small diameter portion and the shaft sealing member is attached to an inner peripheral face of the large diameter portion.

9. The water pump according to claim 4:

wherein the cylindrical portion is provided integrally with a portion constituting a diameter smaller than an outer diameter of the shaft sealing member.

10. The water pump according to claim 9:

wherein the cylindrical portion is provided with a large diameter portion and a small diameter portion, the bearing is attached to an outer peripheral face of the small diameter portion and the shaft sealing member is attached to an inner peripheral face of the large diameter portion.

11. The water pump according to claim 4:

wherein the cylindrical portion is integrally provided with a portion constituting a diameter larger than an inner diameter of the bearing.

12. The water pump according to claim 11:

wherein the cylindrical portion is provided with a large diameter portion and a small diameter portion, the bearing is attached to an outer peripheral face of the small diameter portion and the shaft sealing member is attached to an inner peripheral face of the large diameter portion.

13. The water pump according to claim 4:

wherein the cylindrical portion is provided with a large diameter portion and a small diameter portion, the bearing is attached to an outer peripheral face of the small diameter portion and the shaft sealing member is attached to an inner peripheral face of the large diameter portion.

14. The water pump according to claim 4:

wherein the pulley is provided with a projected portion projected to an outer side in a diameter direction in a space between the shaft sealing member and the bearing.

15. The water pump according to claim 14:

wherein the projected portion is provided on a side of a belt engaging face of the pulley in an axial direction of the pulley.

16. The water pump according to claim 15:

wherein an inner peripheral face of the projected portion forms a storing portion for storing a predetermined amount of a liquid, further comprising:

means for adjusting a level of the liquid stored in the storing portion to be always lower than an inner peripheral face of the belt engaging face.

17. The water pump according to claim 15:

wherein the pulley comprising:

a first space in a ring-like shape at least one face of which is formed by the inner peripheral face of the belt engaging face;

a second space in a ring-like shape at least one face of which is formed by an inner peripheral face of the pulley attached with the bearing; and a communicating portion for communicating the first space and the second space.

18. The water pump according to claim 14:

wherein an inner peripheral face of the projected portion forms a storing portion for storing a predetermined amount of a liquid, further comprising:

means for maintaining level of the liquid stored in the storing portion to be always lower than an inner peripheral face of the belt engaging face.

19. The water pump according to claim 18:

wherein the pulley comprising:

a first space in a ring-like shape at least one face of which is formed by the inner peripheral face of the belt engaging face;

a second space in a ring-like shape at least one face of which is formed by an inner peripheral face of the pulley attached with the bearing; and a communicating portion for communicating the first space and the second space.

20. The water pump according to claim 14:

wherein the pulley comprising:

a first space in a ring-like shape at least one face of which is formed by the inner peripheral face of the belt engaging face;

a second space in a ring-like shape at least one face of which is formed by an inner peripheral face of the pulley attached with the bearing; and a communicating portion for communicating the first space and the second space.

21. The water pump according to claim 20:

wherein the pulley comprising:

a first cylindrical face constituting the belt engaging face, a second cylindrical face constituting the inner peripheral face of the pulley attached with the bearing and a first ring-like face connecting the first and the second cylindrical faces;

a third cylindrical face constituting the shaft; and a second ring-like face connecting the second cylindrical face and the third cylindrical face;

wherein the communicating portion for communicating the first and the second spaces is provided at least either of the second ring-like face and the second cylindrical face.

22. The water pump according to claim 20:

wherein the first and the second spaces are formed integrally with the shaft by bending the pulley by a plurality of times.

* * * * *